US009342055B2

(12) United States Patent
Kasai et al.

(10) Patent No.: US 9,342,055 B2
(45) Date of Patent: May 17, 2016

(54) ELECTRONIC WATCH

(75) Inventors: Tsuneharu Kasai, Tokorozawa (JP); Masahiro Mamiya, Nishitokyo (JP); Michihiro Enokida, Kawagoe (JP); Tetsuro Maruyama, Tokorozawa (JP); Fumio Nakamura, Iruma (JP)

(73) Assignees: CITIZEN HOLDINGS CO., LTD., Tokyo (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 14/117,854

(22) PCT Filed: May 17, 2012

(86) PCT No.: PCT/JP2012/062718

§ 371 (c)(1),
(2), (4) Date: Nov. 15, 2013

(87) PCT Pub. No.: WO2012/157729

PCT Pub. Date: Nov. 22, 2012

(65) Prior Publication Data

US 2014/0086023 A1 Mar. 27, 2014

(30) Foreign Application Priority Data

May 18, 2011 (JP) ..... 2011-111277

(51) Int. Cl.
*G04B 19/04* (2006.01)
*G04B 19/06* (2006.01)
(Continued)

(52) U.S. Cl.
CPC .. *G04G 5/00* (2013.01); *G04C 3/00* (2013.01); *G04C 3/002* (2013.01); *G04C 3/14* (2013.01); *G04C 3/16* (2013.01)

(58) Field of Classification Search
CPC ..... G04C 3/002; G04C 3/14; G04C 3/16
USPC ..... 368/80, 187–189, 238
See application file for complete search history.

(56) References Cited

U.S. PATENT DOCUMENTS 4,522,506 A * 6/1985 Owa ..... G04C 3/005 358/500
5,293,356 A * 3/1994 Chin-Hsing ..... G04C 3/14 368/272

(Continued)

FOREIGN PATENT DOCUMENTS

CN 101206455 A 6/2008
CN 101395543 A 3/2009

(Continued)

OTHER PUBLICATIONS

International Search Report for PCT/JP2012/062718 dated Jun. 19, 2012.

(Continued)

*Primary Examiner* — Amy Cohen Johnson
*Assistant Examiner* — Daniel Wicklund
(74) *Attorney, Agent, or Firm* — Hubbs, Enatsky & Inoue PLLC

(57) ABSTRACT

Provided is an electronic watch capable of surely acquiring a movement start position and a stop position of a hand when the hand moves at high speed such as a case of manual correction by a winding stem or the like, while reducing a load on a CPU. The electronic watch includes: a decode circuit for outputting data corresponding to regions acquired by segmenting a movement range of the hand; and a position information circuit for automatically acquiring region data corresponding to the movement start position of the hand and region data corresponding to the stop position thereof and sending a notification to the CPU when acquiring both the data. In this manner, the CPU can stop until the acquisition of both the data, thereby reducing the load on the CPU.

11 Claims, 28 Drawing Sheets

(51) Int. Cl.

| | |
|---|---|
| ***G04C 9/00*** | (2006.01) |
| ***G04G 5/00*** | (2013.01) |
| ***G04C 3/16*** | (2006.01) |
| ***G04C 3/14*** | (2006.01) |
| ***G04C 3/00*** | (2006.01) |

(56) References Cited

U.S. PATENT DOCUMENTS

| | | | | |
|---|---|---|---|---|
| 5,442,599 | A * | 8/1995 | Burke et al. | 368/187 |
| 5,734,626 | A | 3/1998 | Eckstein | |
| 5,959,941 | A * | 9/1999 | Murakami et al. | 368/80 |
| 6,038,523 | A * | 3/2000 | Akahane et al. | 368/250 |
| 6,088,301 | A * | 7/2000 | Tsuji | 368/28 |
| 6,128,252 | A | 10/2000 | Nosaka | |
| 6,370,087 | B1 * | 4/2002 | Akahane et al. | 368/80 |
| 6,584,040 | B1 * | 6/2003 | Nakajima | G04C 17/0066 368/184 |
| 7,167,417 | B2 * | 1/2007 | Akahane et al. | 368/238 |
| 8,467,274 | B2 * | 6/2013 | Aoki | G04R 60/14 368/187 |
| 2009/0016172 | A1 * | 1/2009 | Fujii et al. | 368/80 |
| 2010/0226214 | A1 * | 9/2010 | Irie et al. | 368/47 |

FOREIGN PATENT DOCUMENTS

| | | | |
|---|---|---|---|
| CN | 101504534 | A | 8/2009 |
| JP | 03-276093 | A | 12/1991 |
| JP | 09-119990 | A | 5/1997 |
| JP | 2935182 | B | 6/1999 |
| JP | 11-231071 | A | 8/1999 |

OTHER PUBLICATIONS

The partial translation of the Office Action dated Oct. 27, 2015 for corresponding Chinese application No. 201280024090.7.

Chinese Office Action dated Oct. 27, 2015 for corresponding Chinese application No. 201280024090.7.

* cited by examiner

FIG.9A

| | D1<br>HOUR HAND MOVEMENT PATTERN | D2<br>HOUR HAND MOVEMENT EXAMPLE | D3<br>REGISTER HOLDING DATA WHEN REGION "0" PROCESSING IS ABSENT | D4<br>DATE INDICATOR DRIVING | D5<br>START POSITION HOLDING REGISTER VALUE | D6<br>STOP POSITION HOLDING REGISTER VALUE |
|---|---|---|---|---|---|---|
| No<br>C1 | WITHIN ZONE A TO ZONE B<br>WITHIN ZONE B TO ZONE A<br>A B C | PK PK PK<br>0 1 2 3 4 5 6 0<br>12 1 3 6 9 11<br>ROUTE[i]<br>ROUTE[ii] | START POSITION HOLDING REGISTER<br>ROUTE [i] 1 - 2 - 3 - 4<br>STOP POSITION HOLDING REGISTER | ○ | 1 | 4 |
| | | | START POSITION HOLDING REGISTER<br>ROUTE [ii] 1 - 0 - 6 - 5 - 4<br>STOP POSITION HOLDING REGISTER | × | 1 | 4 |

FIG.9B

| | D1 HOUR HAND MOVEMENT PATTERN | D2 HOUR HAND MOVEMENT EXAMPLE | D3 REGISTER HOLDING DATA WHEN REGION "0" PROCESSING IS PERFORMED | D4 DATE INDICATOR DRIVING | D5 START POSITION HOLDING REGISTER VALUE | D6 STOP POSITION HOLDING REGISTER VALUE |
|---|---|---|---|---|---|---|
| No | WITHIN ZONE A TO ZONE B | PK PK PK [0] [1] [2] [3] [4] [5] [6] [0] ROUTE[i] ROUTE[ii] | START POSITION HOLDING REGISTER ROUTE [i] 1 2 3 4 STOP POSITION HOLDING REGISTER | ○ | 1 | 4 |
| C1 | WITHIN ZONE B TO ZONE A | | START POSITION HOLDING REGISTER ROUTE [ii] 1 0 6 5 4 STOP POSITION HOLDING REGISTER | × | 6 | 4 |

FIG.9C

| | D1 HOUR HAND MOVEMENT PATTERN | D2 HOUR HAND MOVEMENT EXAMPLE | D3 REGISTER HOLDING DATA WHEN REGION "0" PROCESSING IS ABSENT | D4 DATE INDICATOR DRIVING | D5 START POSITION HOLDING REGISTER VALUE | D6 STOP POSITION HOLDING REGISTER VALUE |
|---|---|---|---|---|---|---|
| C4 | WITHIN ZONE A TO ZONE C<br>WITHIN ZONE B TO ZONE C<br> 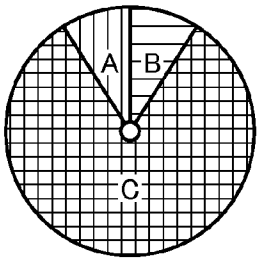 | 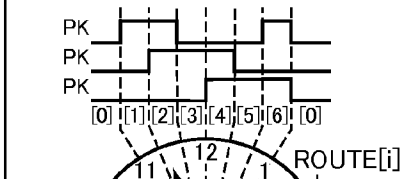 | START POSITION HOLDING REGISTER<br>ROUTE [i] 2 - 3 - 4 - 5 - 6 - 0<br>STOP POSITION HOLDING REGISTER<br>START POSITION HOLDING REGISTER<br>ROUTE [ii] 2 - 1 - 0<br>STOP POSITION HOLDING REGISTER | ○<br>× | 2<br>2 | 0<br>0 |

FIG.9D

| | D1 HOUR HAND MOVEMENT PATTERN | D2 HOUR HAND MOVEMENT EXAMPLE | D3 REGISTER HOLDING DATA WHEN REGION "0" PROCESSING IS PERFORMED | D4 DATE NDICATOR DRIVING | D5 START POSITION HOLDING REGISTER VALUE | D6 STOP POSITION HOLDING REGISTER VALUE |
|---|---|---|---|---|---|---|
| C4 | WITHIN ZONE A TO ZONE C<br>WITHIN ZONE B TO ZONE C<br> 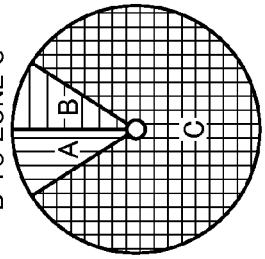 | 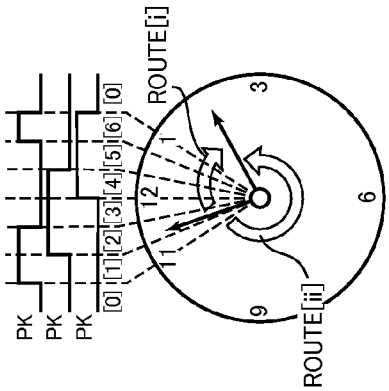 | START POSITION HOLDING REGISTER<br>ROUTE [i] 2 -- 3 -- 4 -- 5 -- 6 -- 0<br>STOP POSITION HOLDING REGISTER<br>START POSITION HOLDING REGISTER<br>ROUTE [ii] 2 -- 1 -- 0<br>STOP POSITION HOLDING REGISTER | ○<br>× | 2<br>2 | 6<br>1 |

ELECTRONIC WATCH

CROSS REFERENCE TO RELATED APPLICATIONS

This application is a National Stage of International Application No. PCT/JP2012/062718 filed May 17, 2012, claiming priority based on Japanese Patent Application No. 2011-111277 filed on May 18, 2011. The contents of each of the above documents are incorporated herein by reference in their entirety.

TECHNICAL FIELD

The present invention relates to an electronic watch having a time display function by hands and a calendar function and being capable of time difference correction by a crown operation.

BACKGROUND ART

Studies have hitherto been made on an electronic watch equipped with a position detection function for detecting the position of a display member such as a hand to control various kinds of correction operations. Patent Literature 1 discloses an electronic watch in which a contact spring mounted to a 24-hour wheel and a detection pattern are used to set a detection section in the range of from 0 degrees to 360 degrees in a hand rotation direction and, when the position of 24 o'clock (midnight) is detected, a day dial is controlled to be advanced one day. The technology of Patent Literature 1 produces its effect on the assumption that the hand is mounted at the 12 o'clock position with high accuracy, but this hand mounting work requires advanced skills and a long work time.

CITATION LIST

Patent Literature

[Patent Literature 1] JP 2935182 B (FIGS. 8 and 9)

SUMMARY OF INVENTION

Technical Problem

Patent Literature 1 describes that the electronic watch also supports the mechanical correction of the hour hand alone by a winding stem, that is, so-called "time difference correction". However, unlike when the position slowly changes such as normal hand movement, the time difference correction involves rotating the hour hand (=24-hour wheel) at high speed, and hence data of the detection pattern changes at high speed as well. However, a microcomputer for use in such a multi-function watch is very low in operation speed in order to reduce power consumption, and is therefore incapable of responding to the high-speed data change of the detection pattern, with the result that an erroneous determination may occur.

Even if a high-speed microcomputer can be used, the microcomputer becomes busy in performing detection pattern processing during the time difference correction, with the result that other processing may not be executed.

In view of the above, it is an object of the present invention to provide an electronic watch in which the hand mounting work can be efficiently performed and which is capable of date indicator driving through an accurate 24-hour determination even when the hand rotates and moves at high speed.

Solution to Problem

In order to solve the above-mentioned problem, an electronic watch according to the present invention includes: a decode circuit configured to segment a whole movable region of an indicator such as a hand and for outputting region data corresponding to the segmented regions; a position information circuit configured to acquire region data corresponding to a movement start position of the indicator (hereinafter referred to as "movement start region data") and region data corresponding to a stop position after start of movement (hereinafter referred to as "stop region data"), and configured to output, when the movement start region data or the stop region data is acquired, an acquisition signal indicating that one or both of the data are acquired; and a control unit configured to acquire the movement start region data and the stop region data from the position information circuit in response to the acquisition signal from the position information circuit, and configured to perform processing relating to the movement of the indicator.

Advantageous Effects of Invention

According to the present invention, even when the control unit such as a CPU is stopped, the position information circuit automatically acquires the movement start position and the stop position of the indicator such as a hand, and outputs the acquisition signal to the CPU after the acquisition. Upon receiving the acquisition signal, the CPU boots up to acquire the movement start position and the stop position and can execute the processing such as date indicator driving. Consequently, the load on the CPU can be reduced to achieve low power consumption.

Further, the CPU can be allocated to another work while the position information circuit is automatically acquiring the movement start position and the stop position, and hence the CPU can be efficiently operated.

BRIEF DESCRIPTION OF DRAWINGS

FIG. 9A is a diagram illustrating how region data acquired by a start position holding register and a stop position holding register differs depending on the presence/absence of region "0" processing for each different hour hand movement pattern.

FIG. 9B is a diagram illustrating how the region data acquired by the start position holding register and the stop position holding register differs depending on the presence/absence of the region "0" processing for each different hour hand movement pattern.

FIG. 9C is a diagram illustrating how the region data acquired by the start position holding register and the stop position holding register differs depending on the presence/absence of the region "0" processing for each different hour hand movement pattern.

FIG. 9D is a diagram illustrating how the region data acquired by the start position holding register and the stop position holding register differs depending on the presence/absence of the region "0" processing for each different hour hand movement pattern.

DESCRIPTION OF EMBODIMENTS

Figure 1A:
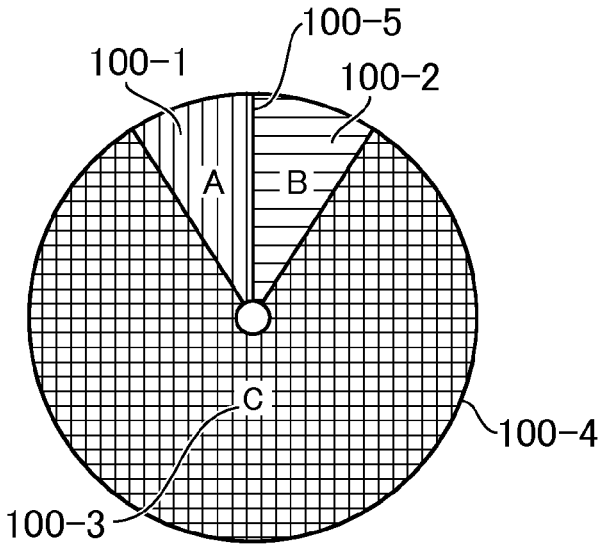
FIG. 1A is a diagram illustrating an hour hand detection region of the present invention.

Referring to the drawings, a description is now given of an electronic watch according to the present invention and the basic principle and embodiments thereof.

Figure 24:
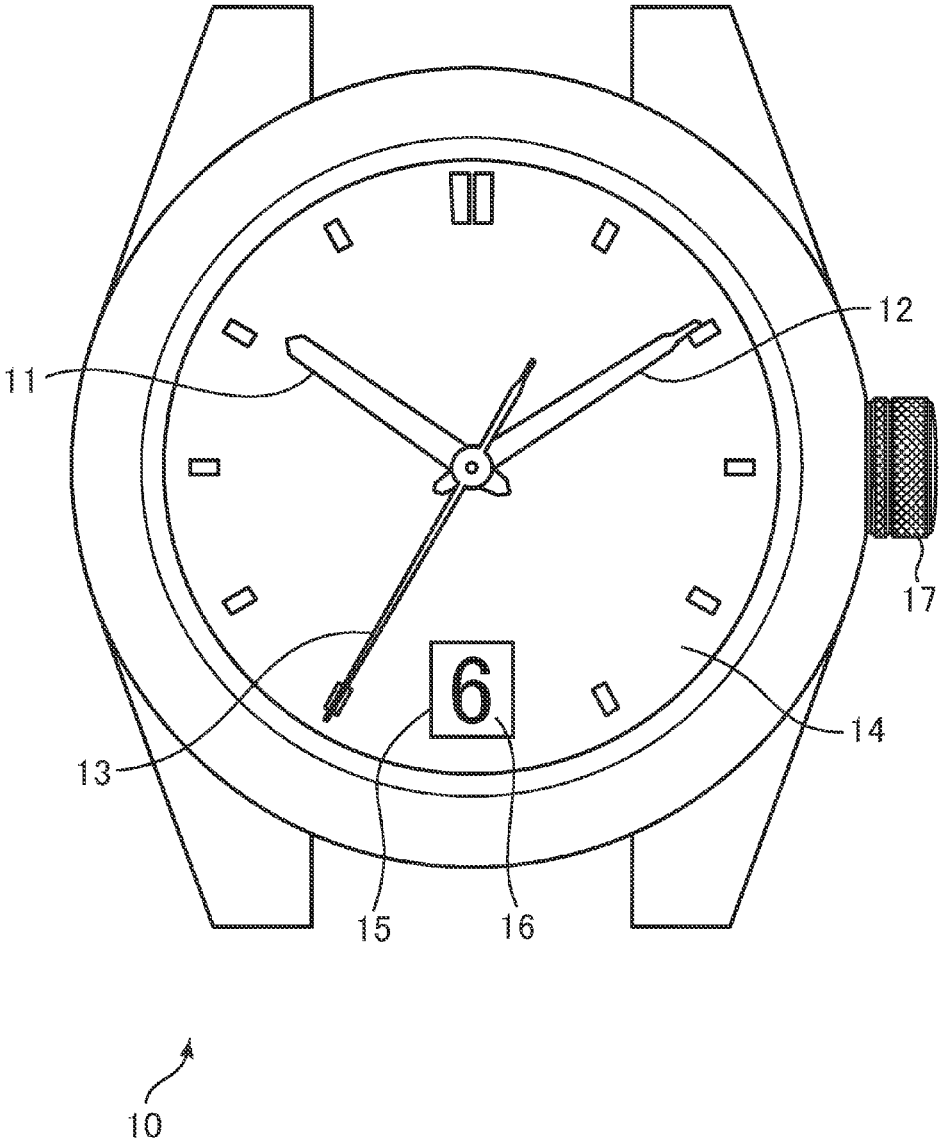
FIG. 24 is an outline plan view of the electronic watch according to the present invention.

An electronic watch 10 according to the present invention is, for example, as illustrated in FIG. 24, a wristwatch having analog hands and date indication. As the hands, an hour hand 11, a minute hand 12, and a second hand 13 are coaxially provided. The date indication printed on a day dial 16 is seen from a date window 15 provided in a watch face 14. The electronic watch 10 as used herein is equipped with at least the analog hour hand 11 and an analog date indication mechanism (the day dial 16 in this case) as indicators. Note that, the day dial 16 illustrated in FIG. 24 is a typical analog date indication mechanism, but another mechanism such as a hand mechanism may be used instead. Time correction is performed by operating a crown 17. Then, date correction is performed along with at least the time correction. Specifically, when the time is corrected in a manner that the time indication of the hands move beyond 12 o'clock (midnight), the date is corrected in conjunction with the time correction. The electronic watch 10 illustrated in FIG. 24 shows the time in the typical 12-hour format, and hence in this case, the date is put forward or back one day each time the hour hand 11 passes the 12 o'clock (midnight) position twice.

A widely known mechanism in the analog watch of the type in which the hands and the date indication mechanism are moved in conjunction with each other as described above is to mechanically connect the hour hand 11 and the day dial 16 to each other. In this mechanism, however, the date indicator driving is performed slowly by spending about 1 hour around 12 o'clock (midnight), and hence it is hard to read the date before and after the change in date. In view of this, such a mechanism that updates the date at high speed when the time indication of the hands moves beyond 12 o'clock (midnight) (called "just update", "datejust", "fast date indicator driving", etc.) has been put into practical use. Also the electronic watch 10 has this mechanism. As an example, the electronic watch 10 as used herein has the mechanism in which a drive mechanism for the hands (namely, the hour hand 11, the minute hand 12, and the secondhand 13) and a drive mechanism for the date indication mechanism (namely, the day dial 16) are separated from each other so that the date indication mechanism is driven by electronically detecting that the time indication of the hands moves beyond 24 o'clock.

Figure 25:
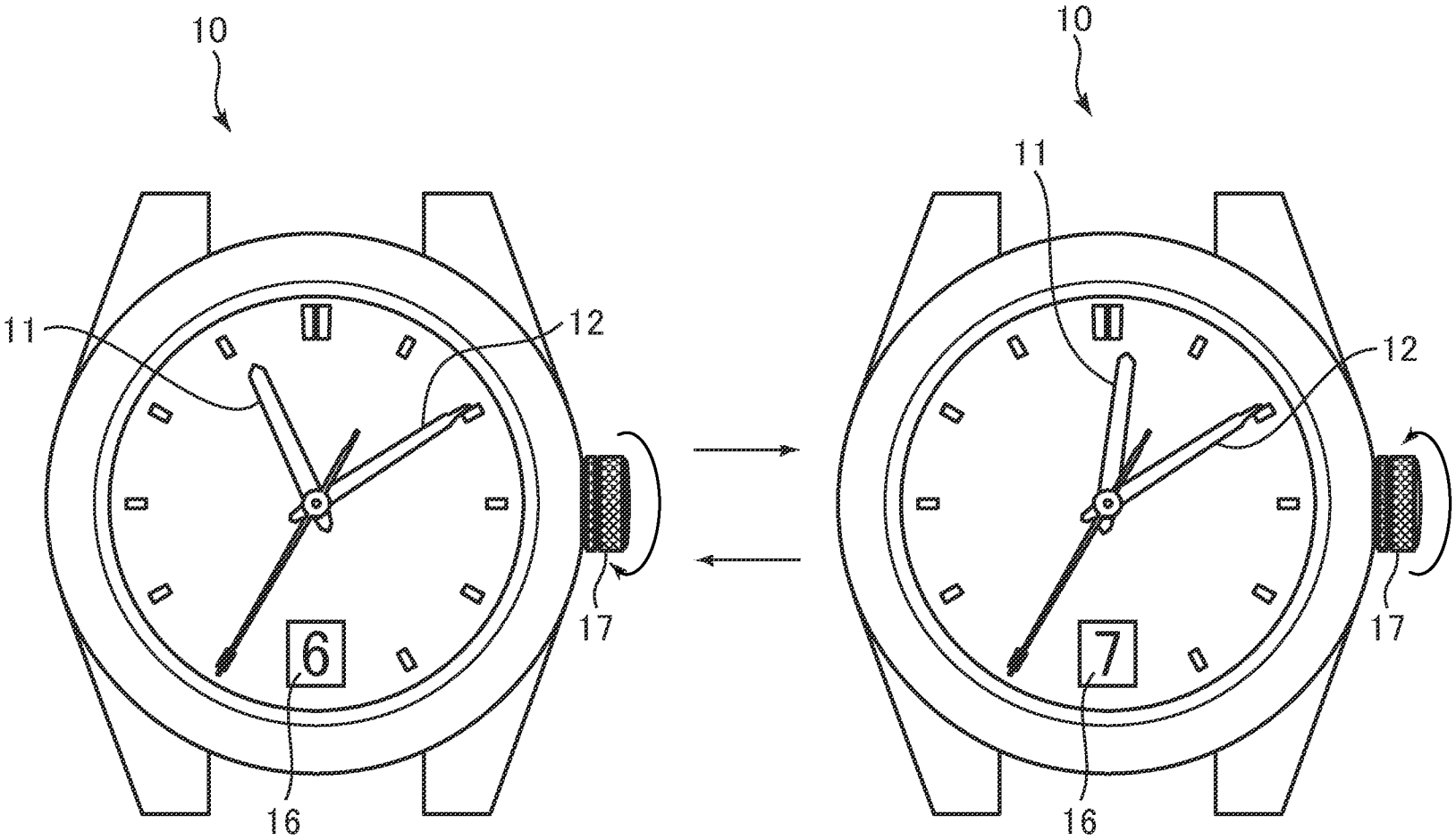
FIG. 25 is a diagram illustrating a date update operation in the electronic watch according to the present invention.

FIG. 25 is a diagram illustrating the operation of updating the date in the electronic watch 10 according to the present invention. For instance, as an example, in the state illustrated in the left of FIG. 25, the electronic watch 10 indicates 6 at 11:09:35 p.m. In this case, when the crown 17 is operated to rotate the hour hand 11 in the forward direction (namely, the clockwise direction) so that the time is adjusted to 00:09:35 a.m. beyond 12 o'clock (midnight) as illustrated in the right of FIG. 25, the day dial 16 is advanced instantaneously (within about 1 to 2 seconds) as illustrated in FIG. 25, and the displayed date is updated from 6 to 7. The same holds true when the reverse operation is performed.

Note that, the operation of rotating the hour hand 11 by operating the crown 17 may be a general time adjustment operation, that is, an operation of rotating the hour hand 11 and the minute hand 12 in conjunction with each other, or may be a time difference correction operation, that is, an operation of rotating only the hour hand 11 independently of the other hands.

Figure 26:
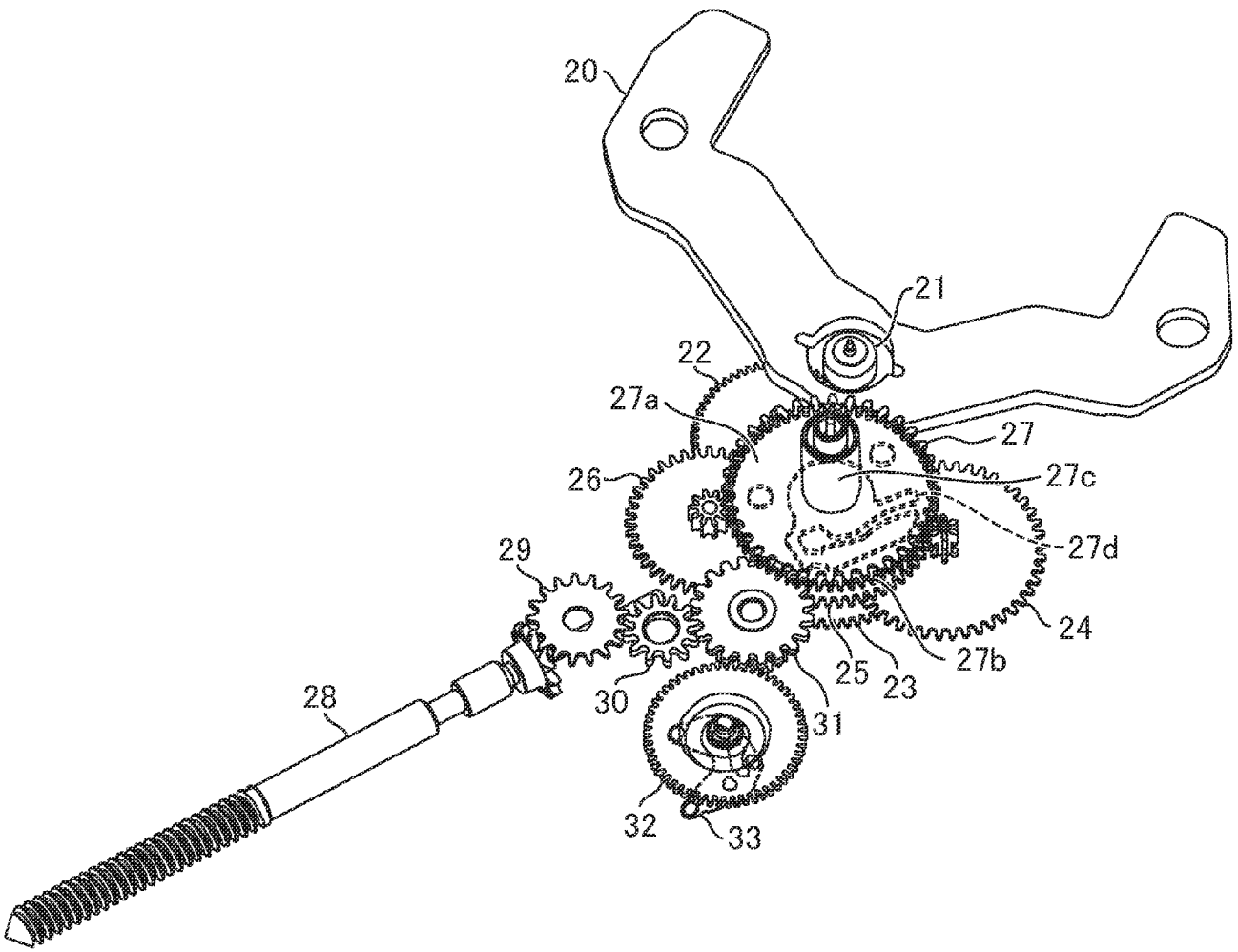
FIG. 26 is a schematic perspective view illustrating a drive mechanism for hands of the electronic watch according to the present invention.

FIG. 26 is a schematic perspective view illustrating the drive mechanism for the hands of the electronic watch 10 according to the present invention. Rotational power taken out from a rotor 21 inserted in an opening portion of a motor stator 20 illustrated in FIG. 26 is transmitted to an hour wheel 27 while being reduced via respective gears of a fifth wheel 22, a fourth wheel 23, a third wheel 24, a center wheel 25, and a minute wheel 26. The hour hand 11 is fixed to the hour wheel 27, the minute hand 12 is fixed to the center wheel 25, and the second hand 13 is fixed to the fourth wheel 23.

A winding stem 28 to which the crown 17 is mounted is engaged with the hour wheel 27 via intermediate wheels 29, 30, and 31, and hence, when the crown 17 is rotated, the hour wheel 27, namely the hour hand 11, can be rotated. In this case, the gears of the hour wheel 27 have a structure in which an upper gear 27*a* and a lower gear 27*b* are overlapped with each other. The upper gear 27*a* meshes with the intermediate wheel 31, and the lower gear 27*b* meshes with a pinion of the minute wheel 26. Then, the upper gear 27*a* is mounted integrally with a cannon part 27*c* of the hour wheel 27, and the lower gear 27*b* is mounted integrally and rotatably with the cannon part 27*c* by a spring mechanism 27*d*. With this mechanism, when the winding stem 28 is rotated, the upper gear 27*a* rotates so that the hour hand 11 rotates in conjunction therewith, but the minute wheel 26 does not rotate because the cannon part 27*c* and the lower gear 27*b* are separated from each other due to an elastic deformation of the spring mechanism 27*d*. Thus, the rotation of the winding stem 28 and the rotations of the minute hand 12 and the second hand 13 are not performed in conjunction with each other. This mechanism realizes a time adjustment operation in which only the hour hand 11 is rotated independently of the minute hand 12 and the second hand 13.

In addition, a switch wheel 32 meshes with the intermediate wheel 31, and the switch wheel 32 rotates in conjunction with the rotation of the hour hand 11. Then, a switch spring 33 is mounted to the switch wheel 32, and the contact spring 33 also rotates in synchronization with the rotation of the switch wheel 32. The switch spring 33 is brought into contact with a circuit board (not shown), and rotates while keeping in contact with the circuit board. In addition, a specific wiring pattern is provided on the circuit board in advance, and by detecting whether or not the wiring pattern and the switch spring 33 are electrically connected to each other, a rotation position of the switch spring 33 and further a rotation position of the hour hand 11 can be detected.

Note that, the mechanism of the electronic watch 10 as described herein is merely an example, and it should be understood that any other kind of electronic watches can be used as long as the electronic watch has at least the analog hour hand 11 and the analog date indication mechanism, and the time indicated by the hour hand 11 and the date displayed on the date indication mechanism are in conjunction with each other at the time of time correction.

[Basic Principle]

First, a description is given of the basic principle of the present invention.

(1) Basic Concept

FIG. 1A simply illustrates a time display surface 100-4 of the watch, illustrating an hour hand determination region to be set in the present invention. Specific regions A 100-1 and B 100-2 are placed around a 12 o'clock (midnight) position 100-5 at which the date is updated, and a region other than the regions A and B is defined as a region C 100-3.

When the presence of the hour hand in the region A, B, or C is recognized by the above-mentioned mechanism or another mechanism such as an encoder, and when the movement of the hour hand from the region A to the region B is recognized, it is determined that the hour hand has passed 12 o'clock (midnight), and the date is put forward one day, and when the movement of the hour hand from the region B to the region A is recognized, it is determined that the hour hand has passed 12 o'clock (midnight), and the date is put back one day. This is the basic concept.

Note that, the watch illustrated in FIG. 1A shows the time in the 12-hour format, and an hour hand 203 to be described later passes the 12 o'clock (midnight) position 100-5 twice a day. A decode circuit 1 to be described later supports a 24-hour wheel (not shown) that makes one turn in 24 hours, and is configured to generate a decoded signal to be described later only around 12 o'clock (midnight). The details are irrelevant to the invention of the present application, and hence the description thereof is omitted.

(2) Decoded Pattern

Figure 1B:
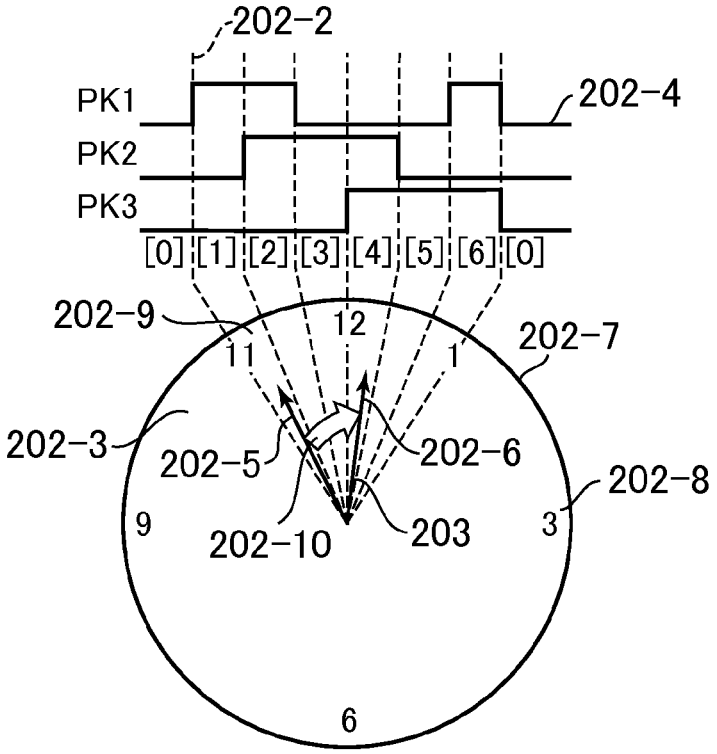
FIG. 1B is a correspondence diagram illustrating a relationship between an hour hand position and an output of a decode circuit corresponding to the position.

FIG. 1B is a correspondence diagram illustrating a relationship between a position of the hour hand 203 and an output of the decode circuit 1 to be described later corresponding to the position.

In FIG. 1B, reference symbols PK1 to PK3 represent the signal names of the output of the decode circuit 1; 202-2, a boundary of a hand position detection region; 202-3, a region "0"; 202-4, an output pattern of the decode circuit with respect to the hand position detection region; 202-5, a movement start position of the hour hand 203; 202-6, a stop position of the hour hand 203; 202-7, an hour face of the watch; 202-8, an hour mark; 202-9, a region "1" as a small divided region; and 202-10, a movement direction of the hour hand.

Note that, the indication members of the watch of the present invention are, in addition to the hour hand 203, a minute hand, a second hand, a day dial that indicates the date, and the like, but those do not constitute the present invention and the illustration thereof is therefore omitted.

Examples of the date indication method include the use of the day dial or a day-of-week dial as well as a display by a small hand and a digital display by an LCD or the like. The selection of the display method is not directly relevant to the present invention, and the selection is optional.

As illustrated in FIG. 1B, the region A 100-1 and the region B 100-2 are more finely divided into small regions, and different values "1" to "6" are set to be output when the hour hand 203 is located in the respective small regions.

The following is the reason why the region A 100-1 and the region B 100-2 are divided into such small regions.

Originally, the 12 o'clock (midnight) position of the hour hand 203 needs to be located in the region between "3" and "4". However, even if the region between "2" and "3" corresponds to the 12 o'clock (midnight) position in terms of hand mounting accuracy, it is only necessary to store data so that the region between "2" and "3" may correspond to the 12 o'clock (midnight) position by internal processing of the watch. Performing such processing eliminates the need of high hand mounting accuracy, thus simplifying a hand mounting step and thereby cutting down the cost.

This correspondence is performed by, for example, installing a dedicated mode for storing the above-mentioned data corresponding to the 12 o'clock (midnight) position in a memory region (not shown) inside the watch at the time of the hand mounting of the hour hand 203. This correspondence originally needs to be performed only at the time of the hand mounting, but, if the hand has displaced by impact or the like, the correspondence may be performed as the occasion demands.

Note that, for simple description, the following description assumes that the positions of "3" and "4" correspond to the 12 o'clock (midnight) position of the hour hand 203 as illustrated in FIG. 1B.

The region C is not finely classified, but the value "0" is set in the region C. The reason is because the region C is a region that is not directly used for determining the 12 o'clock (midnight) position of the hand.

In this manner, the number of pieces of data to be decoded is reduced to simplify the structure of the decoder to be described later.

The small regions illustrated in FIG. 1B are divided as six small regions in total, three regions A and three regions B. The reason is because those regions can be produced easily only with the bifurcated contact spring and the three input terminals disclosed in Patent Literature 1, for example. FIG. 1B illustrates a pattern diagram of the input terminals PK in the case where the regions are produced with such a structure. Note that, the values of PK do not match with the values "1" to "6" of the small regions, but can be converted through an appropriate decoder. Thus, the following description assumes that the small regions "1" to "6" are acquired as the numerical values output through the decoder.

Note that, the mechanical and electrical configurations of the decoder are not essential for the present invention, and hence the description thereof is omitted.

It should be understood that the present invention is not limited to the decoded pattern illustrated in FIG. 1B. The number of the small regions, and the decoded numerical values corresponding to the respective small regions and the region C can be arbitrarily set as long as the present invention can be embodied.

(3) Method of Determining the Passage Through the 12 O'Clock (Midnight) Position Using a method to be described later, decode data corresponding to a start position and a stop position of hand driving is stored, and the pieces of decode data are compared after the stop of the hand driving, to thereby determine the presence/absence of the passage through the 12 o'clock (midnight) position and its direction.

Specifically, when "1" to "3" being the region A are stored as the start position and "4" to "6" being the region B are stored as the stop position, the movement from the region A to the region B is recognized and the date is put forward one day, and when "4" to "6" being the region B are stored as the start position and "1" to "3" being the region A are stored as the stop position, the movement from the region B to the region A is recognized and the date is put back one day. In the following, the computation processing and the mechanical operation for advancing and returning the date indication are collectively referred to as "date indicator driving processing".

EMBODIMENTS

Next, a specific circuit configuration for achieving the above-mentioned basic principle is described with reference to the drawings.

Figure 2:
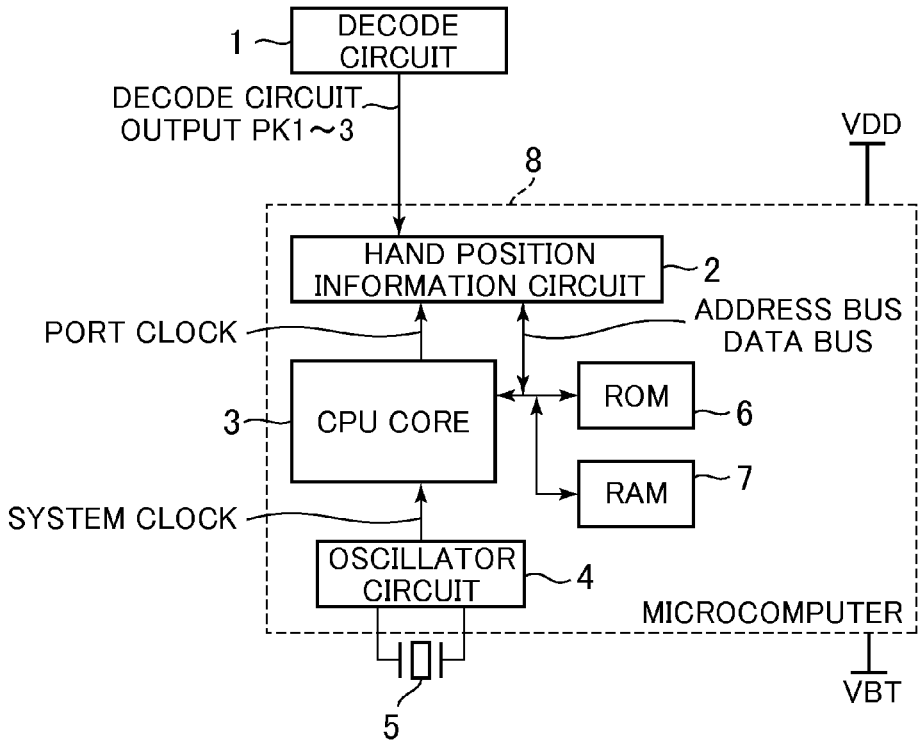
FIG. 2 is a block diagram illustrating an overall system configuration of an electronic watch according to embodiments of the present invention.

FIG. 2 is a block diagram illustrating an overall system configuration of an electronic watch according to embodiments of the present invention. Note that, FIG. 2 is used in common to the individual embodiments to be described later.

Reference numeral 1 represents the above-mentioned decode circuit, which outputs a value corresponding to the position of the hour hand 203 (not shown in FIG. 2). Reference numeral 2 represents a hand position information circuit for receiving the output from the decode circuit 1, which is the feature of the present invention, to determine and store information relating to the position of the hour hand 203, specifically, a movement start position and a stop position.

Reference numeral 3 represents a CPU; 4, a crystal oscillator circuit using a crystal oscillator 5; 6, a ROM for storing a program; and 7, a RAM to be used for various kinds of information processing. Those components construct a general microcomputer. The hand position information circuit 2 is constructed as a peripheral circuit of the CPU 3, and various kinds of hand position information are transmitted to the CPU 3 via a bus or a control line. In other words, the features of the overall system of the present invention reside in the decode circuit 1 and the hand position information circuit 2, and a commonly-used watch microcomputer system can be used for the other portions.

The hand position information circuit 2 is booted up by the CPU 3 in a time difference correction mode in which the hour hand 203 moves at high speed and other such modes. In other states such as a normal use state in which the hour hand 203 moves at low speed or stops, the hand position information circuit 2 is stopped. During the stop of the hand position information circuit 2, the output of the decode circuit 1 is configured so as to be directly processed by the CPU 3 not via or just passing through the hand position information circuit 2.

With this configuration, the output of the decode circuit 1 is configured so as to be directly processed by the CPU 3 and the hand position information circuit 2 is stopped in the state in which the hour hand 203 moves at low speed or stops, and the hand position information circuit 2 can be operated only in the time difference correction mode in which the hour hand 203 moves at high speed and other such modes. Consequently, the power consumption can be reduced.

Note that, in FIG. 2, the hand position information circuit 2 is illustrated as being configured inside the microcomputer, but the present invention is not limited thereto, and the hand position information circuit 2 may be configured as another circuit (IC) outside the microcomputer.

In this manner, a commonly-used commercially available watch microcomputer can be used as the microcomputer.

The decode circuit 1 is connected to input terminals PK1 to PK3 of the hand position information circuit 2. To the input terminals PK1 to PK3, the values illustrated in FIG. 1B are output with respect to the regions "0" and "1" to "6".

Note that, the numbers of the regions "1" to "6" do not match with the decoded data as described above, but, by converting the regions through an appropriate decoder (not shown), the hand position information circuit 2 performs processing with the values "0" and "1" to "6". The values "0" and "1" to "6" after processed by the hand position information circuit 2 are hereinafter referred to as "region data".

As described above, the decode circuit 1 according to this embodiment can be produced by a simple configuration of the bifurcated contact spring and the three input terminals PK1 to PK3, and hence such a decode circuit is employed. It should be, however, understood that the decode circuit is not limited thereto.

Based on hour hand detection region data that is input from the decode circuit 1 in accordance with the movement of the hour hand 203, the hand position information circuit 2 holds a movement start region and a movement stop region of the hour hand by a method to be described later, and outputs the movement start region and the movement stop region to the CPU 3. Based on the movement start region data and the movement stop region data acquired from the hand position information circuit 2, the CPU 3 determines whether or not the hour hand has moved beyond the 12 o'clock (midnight) position, and performs the date indicator driving processing.

Next, the basic operation of the hand position information circuit 2 is described with reference to a block diagram of FIG. 3 and a flow chart of FIG. 4.

Figure 3:
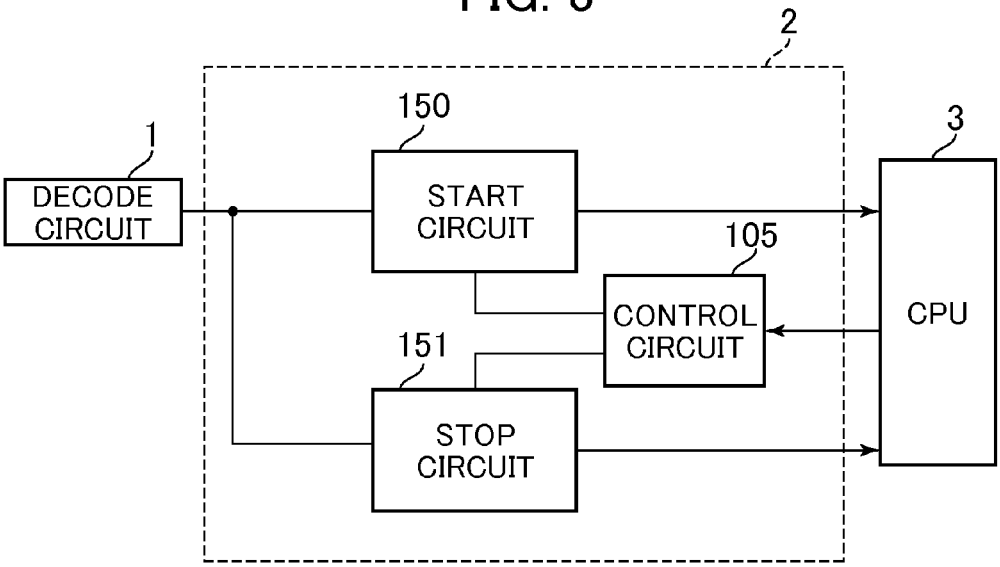
FIG. 3 is a basic block diagram of a hand position information circuit of the electronic watch according to the embodiments of the present invention.
Figure 4:
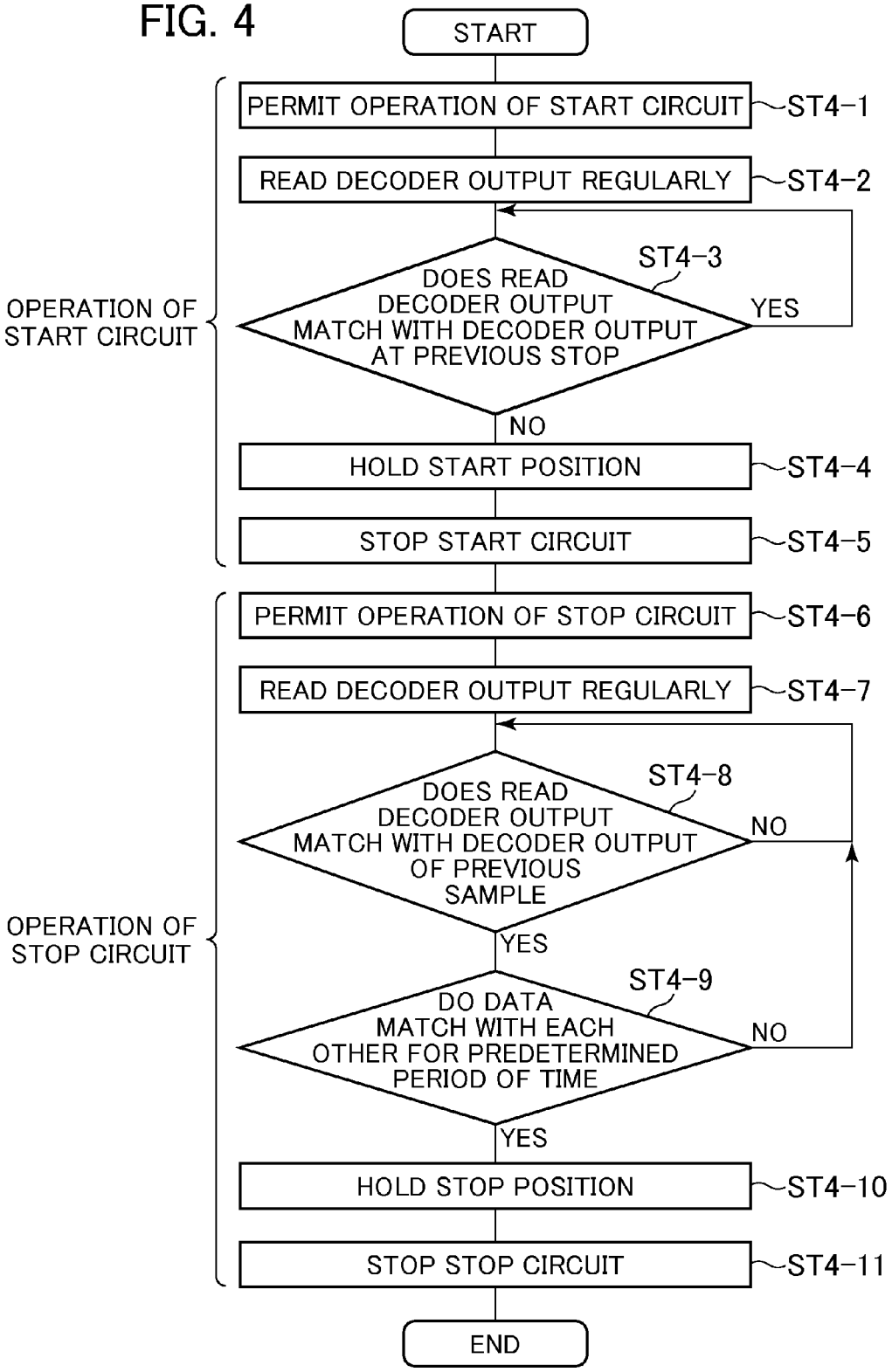
FIG. 4 is a flow chart illustrating a basic operation of the hand position information circuit of the electronic watch according to the embodiments of the present invention.

As illustrated in FIG. 3, the hand position information circuit 2 is roughly divided into a start circuit 150 and a stop circuit 151, and the operations thereof are controlled by the control circuit 105.

The start circuit 150 is a circuit for acquiring decoded data of a region where the hour hand starts to move (hereinafter referred to as "movement start region data"). When the automatic position acquisition by the hand position information circuit 2 is necessary for the time difference correction or the like, the control circuit 105 receives a boot-up command from the CPU 3 to boot up the start circuit 150, and the start circuit 150 executes the operation of acquiring the start region data. When the acquisition of the movement start region data is finished, the control circuit 105 stops the operation of the start circuit 150 except for a part of the circuit for fetching the data of the decode circuit 1.

The stop circuit 151 is a circuit for acquiring decoded data of a region where the hour hand stops (hereinafter referred to as "movement stop region data"). The stop circuit 151 continues its stopping status even after the boot-up of the start circuit 150, and, when the start circuit 150 acquires the start region data and stops, the stop circuit 151 is booted up by the control circuit 105 to execute the operation of acquiring the stop region data. When the acquisition of the stop region data is finished, the control circuit 105 stops the stop circuit 151.

As described above, the start circuit 150 operates first, and the stop circuit 151 operates after the end of the operation of the start circuit 150. In other words, the start circuit 150 and the stop circuit 151 operate independently and do not operate simultaneously. This is because the start circuit 150 and the stop circuit 151 do not need to be operated simultaneously in view of the roles of the respective circuits. In this manner, low power consumption of the hand position information circuit 2 is achieved.

The timing at which the stop circuit 151 starts its operation may be the same as the timing at which the start circuit 150 finishes its operation. In this case, the stop circuit 151 starts to operate without waiting for the end of the operation of the start circuit 150, and hence, when the movement of the hour hand has stopped immediately after the start of movement, the time until the stop determination can be decreased. For easy understanding of the operation, the following description assumes that the stop circuit 151 operates after the end of the operation of the start circuit.

[Start Position Determination Method]

When the start circuit 150 in the hand position information circuit 2 is permitted to operate (ST4-1), the start circuit 150 regularly acquires region data output from the decoder circuit 1 (ST4-2). Then, the pieces of the successively-acquired hour hand detection region data are compared (ST4-3). When the pieces of region data do not match with each other (ST4-3: NO), the start circuit 150 recognizes that the hour hand 203 has started to move, and stores the hour hand detection region data at the time of the start of movement as the movement start position (ST4-4). On the other hand, when the compared pieces of region data are not different from each other (ST4-3: YES), the start circuit 150 determines that the hour hand has not moved, and continues the comparison.

[Stop Position Determination Method]

Upon the detection of the start of movement of the hour hand, the control circuit stops the start circuit 150 (ST4-5), subsequently permits the operation of the stop circuit 151 (ST4-6), and regularly acquires the region data from the decoder circuit 1 (ST4-7). The stop circuit 151 compares the newly read region data with the region data read in the previous sampling (ST4-8). When the pieces of the region data match with each other (ST4-8: YES), the stop circuit 151 recognizes that the hour hand 203 has stopped, and then determines whether or not the pieces of the region data match with each other for a predetermined period of time (ST4-9). When the pieces of the region data match with each other for the predetermined period of time (ST4-9: YES), the stop circuit stores the region data as the movement stop position (ST4-10), and stops its operation (ST4-11).

On the other hand, when the comparison result in ST4-8 indicates that the pieces of data do not match with each other (ST4-8: NO) or when it is not confirmed in ST4-9 that the pieces of data match with each other for the predetermined period of time (ST4-9: NO), the stop circuit 151 further continues the comparison of the region data. Note that, the predetermined period of time is set so that it is surely determined that the hour hand has stopped during the passage through the region C, thereby being compatible also with the continuous rotation of the hand (continuous hour hand position correction by the crown). The details are described later.

First Embodiment

Subsequently, detailed embodiments are sequentially described.

Figure 5:
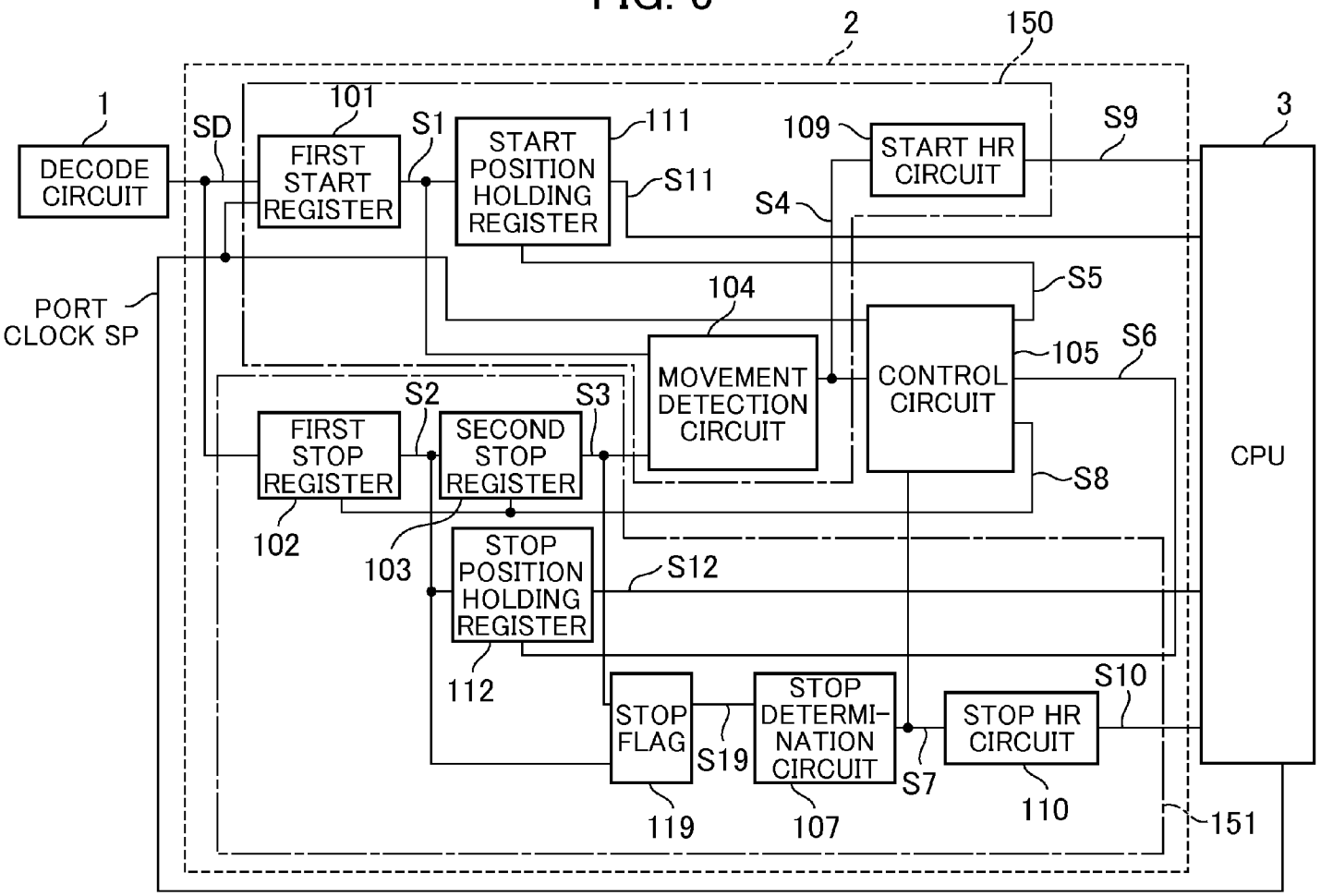
FIG. 5 is a block diagram of a hand position information circuit according to a first embodiment of the present invention.

FIG. 5 is a block diagram illustrating a detailed configuration of the hand position information circuit 2 according to a first embodiment of the present invention. In the hand position information circuit 2 according to the first embodiment, the start circuit 150 includes a first start register 101 for determining the start of movement, a start position holding register 111 for storing a start position, a movement detection circuit 104 for detecting the start of movement by comparing the first start register 101 and a first stop register 102 to be described below and for outputting a signal S4 that indicates the detection, and a start HR circuit 109 for outputting a signal S9 that informs the CPU 3 of the detection of the start of movement, and the stop circuit 151 includes the first stop register 102 and a second stop register 103 to be used for determining the start of movement and determining the stop, a stop position holding register 112 for storing a stop position, a stop flag circuit 119 for outputting a signal S19 that boots up a stop determination circuit 107 to be described below, the stop determination circuit 107 that is booted up by the signal S19 to determine the stop by counting a stop time, and a stop HR circuit 110 for outputting a signal S10 that informs the CPU 3 of the detection of the stopping of movement. The role of the control circuit 105 is to control the overall hand position information circuit 2 as shown in FIG. 3.

A circuit system surrounded by a chain line is the start circuit 150 and a circuit system surrounded by another chain line is the stop circuit 151. As used herein, HR stands for a halt release signal (signal for releasing the halt state of the CPU 3), and is a processing request signal for the CPU 3.

The decode circuit 1 inputs region data to the hand position information circuit 2 in accordance with a region at which the hour hand 203 is located. In the hand position information circuit 2, region data SD is input to the first start register 101 and the first stop register 102. The first start register 101 needs to fetch the data all the time, and hence operates also during the stop of the start circuit 150. An output S1 of the first start register 101, which is the latest region data, is input to the start position holding register 111 and the movement detection circuit 104. An output S2 of the first stop register 102, which is the latest region data, is input to the second stop register 103, the stop position holding register 112, and the stop flag circuit 119. An output S3 of the second stop register 103 is input to the movement detection circuit 104 and the stop flag circuit 119.

The output S4 of the movement detection circuit 104 is input to the start HR circuit 109 and the control circuit 105, and the output S19 of the stop flag circuit 119 is input to the stop determination circuit 107. An output S7 of the stop determination circuit 107 is input to the control circuit 105 and the stop HR circuit 110, and the outputs S9 and S10 of the start HR circuit 109 and the stop HR circuit 110 are input to the CPU 3, respectively.

As a clock signal for the registers, a port clock signal SP is input to the first start register 101 and the control circuit 105. As described above, the port clock signal SP is always output during the operation of the hand position information circuit 2.

An output S5 of the control circuit 105 is a clock signal that is produced based on the port clock signal SP and output only when necessary, and is input to the start position holding register 111.

An output S6 of the control circuit 105 is also a clock signal that is produced based on the port clock signal SP and output only when necessary, and is input to the stop position holding register 112.

Similarly, an output S8 of the control circuit 105 is a clock signal that is produced based on the port clock signal SP and output only when necessary, and is input to the first stop register 102, the second stop register 103, and the stop determination circuit 107.

Description of the Operation in the First Embodiment

Figure 6:
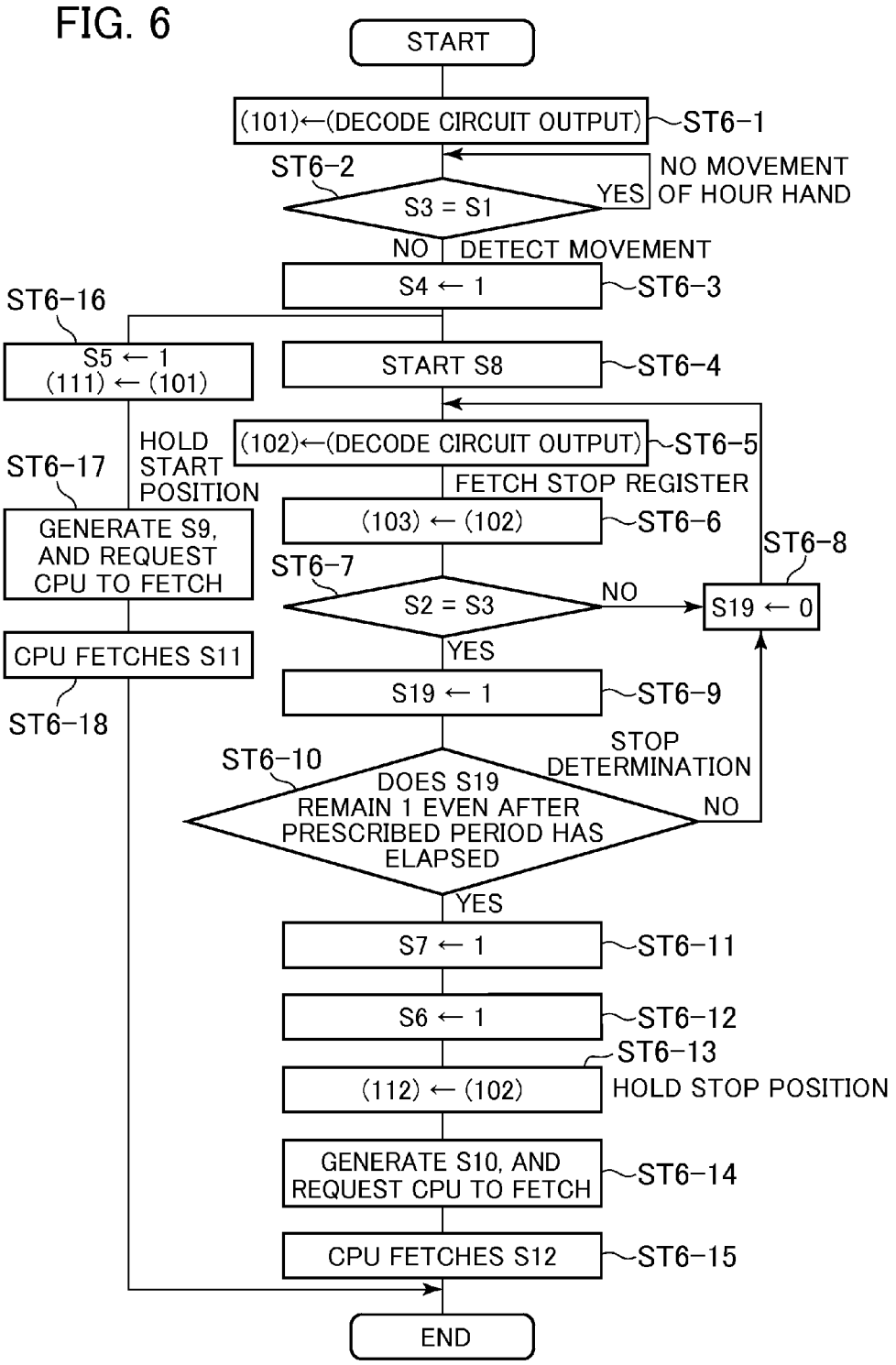
FIG. 6 is a flow chart illustrating details of processing of the hand position information circuit according to the first embodiment of the present invention.

Next, the operation of the hand position information circuit 2 shown in FIG. 5 is described with reference to a flow chart of FIG. 6.

[1] Acquisition of Movement Start Region

The first start register 101 acquires the region data SD from the decode circuit 1 at a change timing of the port clock signal SP supplied from the CPU 3 (ST6-1). The change timing as used herein refers to any one of a rising edge and a falling edge of the signal.

The output S3 of the second stop register 103 holds the region data SD indicating the region at which the hour hand 203 stopped last time. The movement detection circuit 104 compares the output S3 of the second stop register 103 and the output S1 of the first start register 101 to each other (ST6-2). When the pieces of region data are different from each other (ST6-2: NO), it is determined that the hour hand 203 has started to move, and S4 is generated (ST6-3).

Note that, the "generation of signal S*" as used herein means an activation of a clock signal that has been stopped in the case of a clock signal, and means outputting an active signal, signal "1" in this embodiment, in the case of a control signal.

Upon the generation of S4 meaning the detection of the start of movement, the control circuit 105 generates S5 as a start position holding signal, and controls the start position holding register 111 to hold a value of the first start register 101 (ST6-16). In this case, the start position holding register 111 only needs to hold the region data acquired when the hour hand has started to move, and hence may hold the output S3 of the second stop register 103. In addition, upon the generation of the start position holding signal S5, the start HR circuit 109 generates S9 as an HR signal indicating the detection of movement start position data to the CPU 3 to prompt the CPU 3 to acquire the region data (ST6-17). The CPU 3 receives the HR signal S9 and fetches region data S11 held by the start position holding register 111 (ST6-18). In this manner, the fetch of the movement start position data is finished, and the operation of the start circuit 130 is finished.

[2] Acquisition of Movement Stop Region

Upon the generation of S4 meaning the detection of the start of movement, the control circuit 105 generates S8 as the operating clock for the first stop register 102 and the second stop register 103 (ST6-4).

At a change timing of S8, the control circuit 105 controls the first stop register 102 to hold the region data SD of the output of the decode circuit 1 (ST6-5), and simultaneously controls the second stop register 103 to hold the output S2 of the first stop register 102 (ST6-6).

The stop flag circuit 119 compares S2 and S3, which are the outputs of the first stop register 102 and the second stop register 103 (ST6-7). When both the data are equal to each other (ST6-7: YES), the stop flag circuit 119 determines that the hour hand 203 is possibly in the stop state, and generates the stop flag S19 (ST6-9). When S2 and S3 are not equal to each other (ST6-7: NO), the stop flag circuit 119 determines that the hour hand 203 is not in the stop state but is moving, and the processing is performed again starting from the fetch of the region data SD of the decode circuit 1 (ST6-5) without generating S19 (ST6-8).

The stop determination circuit 107 counts the time during which the stop flag S19 is generated (S19=1) (ST6-10). When S19 is continuously generated for a predetermined period of time (ST6-10: YES), the stop determination circuit 107 determines that the hour hand has stopped, and generates S7 (ST6-11).

On the other hand, when S19 is not generated for a predetermined period of time (ST6-10: NO), the stop determination circuit 107 considers the hour hand not to have stopped completely, and resets S19 to 0 (ST6-8). Then, the processing is performed again starting from the fetch of the region data SD of the decode circuit 1 (ST6-5).

Note that, the stop determination circuit 107 is configured as a timing counter (timer) for counting an appropriate clock. The clock for counting is configured to be supplied to the stop determination circuit 107 only when S19=1. The details of the stop determination circuit 107 are described in a fourth embodiment of the present invention.

Upon the generation of S7 indicating the stop determination, the control circuit 105 generates a signal S6 for operating the stop position holding register 112 (ST6-12), and the stop position holding register 112 holds the output S2 of the first stop register 102 (ST6-13). Further, upon the generation of S7, the stop HR circuit 110 generates S10 to prompts the CPU 3 to acquire the stop position region data (ST6-14), and the CPU 3 fetches the region data S12 of the stop position holding register 112 (ST6-15). Note that, upon the generation of S10, S8 being the operating clock for the first stop register 102 and the second stop register 103 is stopped, and thereby, the operation of the stop circuit 151 is finished.

[3] Processing of the CPU 3

Figure 7:
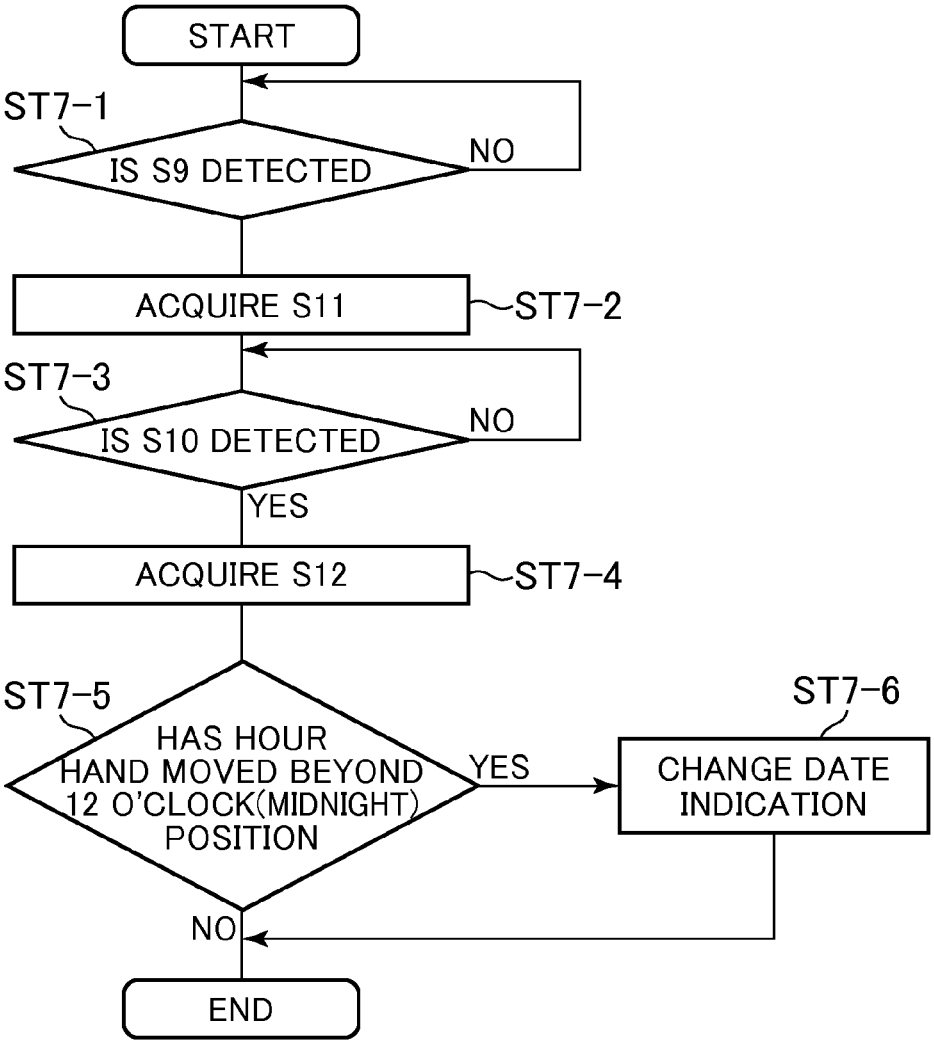
FIG. 7 is a flow chart illustrating processing performed by a CPU according to the first embodiment of the present invention.

Next, the operation of the CPU 3 for acquiring information of the hand position information circuit 2 is described with reference to a flow chart illustrated in FIG. 7.

The CPU 3 normally stops in the HALT state, and starts its operation in response to a HALT release signal (HR signal). The CPU 3 waits in the HALT state for an HR signal S9 indicating the acquisition of the start position (ST7-1), and starts its operation when the HR signal S9 is generated (ST7-

1: YES) to acquire region data S11 indicating the movement start position (ST7-2). When the region data S11 is acquired, the CPU 3 changes to the HALT state again. Note that, the HR signal S9 is reset by the CPU 3 when the HALT is released. The same holds true for the other HR signals.

Subsequently, the CPU 3 waits in the HALT state for an HR signal S10 indicating the acquisition of the stop position (ST7-3), and starts its operation when the HR signal S10 is generated (ST7-3: YES) to acquire region data S12 indicating the movement stop position (ST7-4). Based on the acquired movement start position region data and movement stop position region data, it is determined whether the hour hand 203 has passed the 12 o'clock (midnight) position (ST7-5). When the hour hand 203 has passed the 12 o'clock (midnight) position (ST7-5: YES), the operation of updating the date indication is performed (ST7-6).

As described above, even when the hour hand 203 operates at high speed, the hand position information circuit 2 can acquire the movement start position and the movement stop position of the hour hand 203, and the operation of the CPU 3 can be stopped during this period. By setting the speed of the operating clock (such as SP) of the hand position information circuit 2 to be lower than the speed of the operating clock of the CPU 3, the power consumption can be reduced as compared with the case where the processing is performed by the CPU 3.

Further, in the case where the CPU 3 is not brought into the HALT state, the CPU 3 can be allocated to another processing, and hence the processing efficiency of the CPU 3 can be improved.

[4] Description with Reference to a Time Chart of the Hand Position Information Circuit 2

Figure 8:
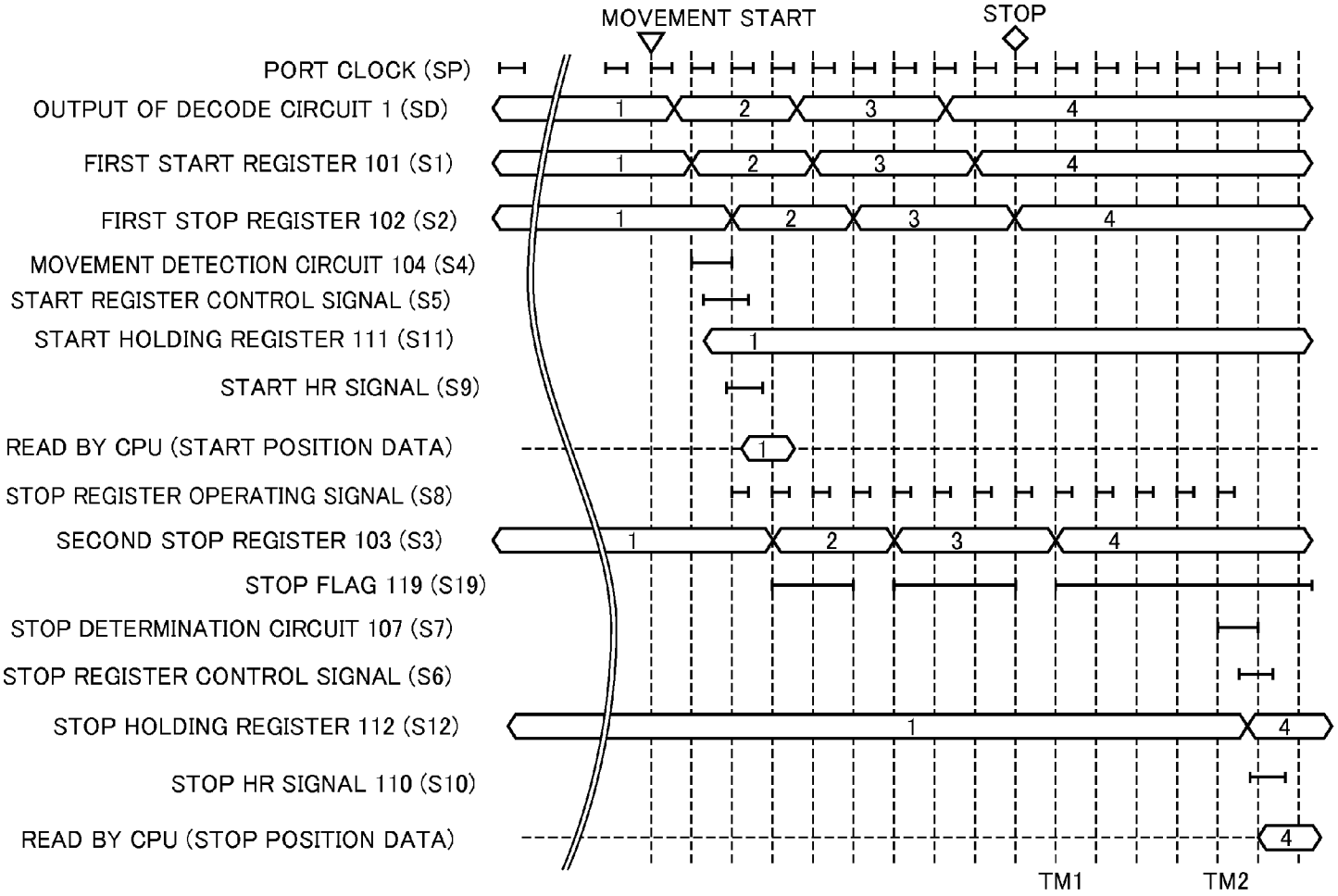
FIG. 8 is a time chart illustrating an operation of the hand position information circuit according to the first embodiment of the present invention.

FIG. 8 illustrates the operation of the hand position information circuit 2 illustrated in FIG. 5 in the form of a time chart, illustrating the flow of data of the signal lines illustrated in FIG. 5 in time series. Note that, the time range marked with a line indicates an active "1", and the time range not marked with a line indicates a negative "0". A description is given herein of the example where the hour hand 203 has moved from the region "1" to the region "4".

The first start register 101 in the start circuit 150 acquires the hour hand position region data SD from the decoder 1 in response to the port clock SP, and the movement detection circuit 104 compares the stop region data S3 of the second stop register 102 and the output S1 of the first start register 101. When both the data do not match with each other, the movement detection signal S4 becomes "1", and the start register control signal S5 is generated to hold the region data of the first start register 101 in the start position holding register 111. After that, the start HR signal S9 becomes "1", and the CPU 3 acquires the region data of the start position holding register 111.

Note that, the port clock SP is a clock to be supplied continuously from the CPU 3 during the operation of the hand position information circuit 2. The operation thereof does not need to be described particularly, and hence the illustration is omitted in the following time charts.

In response to the generation of S4 indicating the movement start detection of the hour hand 203, the stop register operating signal S8 as the clock for the first and second stop registers 102 and 103 is generated.

In response to the clock S8, the first and second stop registers 102 and 103 acquire the region data SD from the decoder circuit 1 in a serial manner. When the outputs of the first and second stop registers 102 and 103 are the same data, the output S19 of the stop flag circuit 119 becomes "1" (TM1). When the period of "1" lasts for a predetermined period of time, the output S7 of the stop determination circuit 107 becomes "1" to generate the stop register control signal S6 (TM2), and the region data of the first stop register 102 is held in the stop position holding register 112. After that, the stop HR signal S10 becomes "1", and the CPU 3 acquires the region data of the stop position holding register 112. After that, the CPU determines whether to perform the date indicator driving based on the region data of the start position holding register and the stop position holding register, and performs the processing.

As understood from FIG. 8, except for the port clock SP for the first start register, the clocks S5 and S8 for data acquisition into the registers are configured to be generated only when the holding operation of the corresponding register is necessary. In this manner, an unnecessary clock operation is suppressed to reduce the power consumption.

Besides, the CPU 3 stops its operation except for the acquisition of the start position data S11 and the stop position data S12, and hence the power consumption can be reduced.

Second Embodiment

The processing of the hand position information circuit according to the first embodiment is effective when the hour hand has moved in the range of from "1" to "6" of the detection regions. On the other hand, if the region "0" is finely divided as exemplified by the regions "1" to "6" and a decoded signal corresponding to each region is output, the hand position of the hour hand can be grasped all the time, and the start and stop of the movement can quickly be detected. However, the object of this system is to determine whether or not the hour hand has moved beyond the 12 o'clock (midnight) position, and hence there is a little advantage in acquiring position information of the hour hand in a region other than the plurality of regions around the 12 o'clock (midnight) position. Further, if the number of combinations of decoded data is increased, decoding cannot be achieved by a simple configuration of the bifurcated contact spring and the three input terminals PK1 to PK3 as described above, which is disadvantageous in terms of cost and size. Thus, in this embodiment, the region other than the regions "1" to "6" around the 12 o'clock (midnight) position is defined as the region "0" and is represented by single decoded data.

The second embodiment enables the determination of the rotation direction of the hour hand even when the hour hand has moved to pass the region "0" or to stop in the region "0" or when the region "0" is the start position.

Specifically, the feature of the second embodiment resides in that, only when the hour hand has passed the region "0" or when the hour hand has started to move from the region "0", data on a region at which the hour hand has arrived next to the region "0" is held in the start position holding register 111, and that, when the hour hand has stopped in the region "0", data on a region at which the hour hand has arrived just before the region "0" is held in the stop position holding register 113. This processing is hereinafter referred to as "region '0' processing".

Prior to describing the configuration of the second embodiment, the problem that occurs when the hour hand has passed the region "0" or stopped in the region "0" or when the region "0" is the start position is described with reference to FIGS. 9A to 9D.

FIGS. 9A, 9B, 9C, and 9D distinguish movement patterns of the hour hand, illustrating how the region data acquired by the start position holding register 111 and the stop position holding register 112 differs depending on the presence/absence of the region "0" processing.

The column D1 in FIGS. 9A to 9D indicates the pattern of how the hour hand moves among the respective zones A, B, and C. The column D2 gives a specific example of the hour hand movement pattern of the column D1, in which the pattern is classified into the routes "i" and "ii" depending on the movement direction.

FIGS. 9A and 9C illustrate the case where the processing on the region "0" is not performed. The column D3 illustrates pieces of hour hand detection region data that are output from the decode circuit in the short hand movement routes "i" and "ii" illustrated in the column D2. The columns D5 and D6 illustrate pieces of region data of the start position holding register 111 and the stop position holding register 112 to be output to the CPU 3, respectively. The column D4 indicates the necessity of date indicator driving. Note that, the necessity as used herein indicates whether or not the date indicator driving is originally necessary in each of the cases of the routes "i" and "ii", and does not indicate the result determined based on the region data of the start position holding register 111 and the stop position holding register 112.

FIGS. 9B and 9D illustrate the case where the above-mentioned processing on the region "0" is performed. FIGS. 9B and 9A and FIGS. 9D and 9C describe the same hour hand movement patterns.

[1] Description of Movement Pattern C1

In the hour hand movement pattern of the column D1 in FIGS. 9A and 9B, the hour hand moves from one of the zone A and the zone B to the other. In the example of the hour hand movement of the column D2 in FIGS. 9A and 9B, the hour hand 203 moves from the detection region "1" to the detection region "4". In the route "i", the hour hand detection region changes in the order of "1", "2", "3", and "4". In the route "ii", the hour hand detection region changes in the order of "1", "0", "6", "5", and "4". In the route "i", the hour hand moves beyond the 12 o'clock (midnight) position, and hence the date indicator driving is necessary. In the route "ii", the date indicator driving is unnecessary.

In FIG. 9A, the region "0" processing is not performed, and hence, when the hour hand passes the region "0", as indicated by the register values of the columns D5 and D6, the start position holding register value and the stop position holding register value are identical in the route "i" and the route "ii", and hence the rotation direction cannot be discriminated.

In FIG. 9B, in the route "i", the start position holding register value holds "1", and the stop position holding register value holds "4". On the other hand, in the route "ii", the hour hand passes the region "0", and hence, by performing the region "0" processing, the start position holding register value holds "6" that is the region next to the region "0", and the value of the stop position holding register 112 holds "4". Thus, the CPU 3 can determine the rotation direction of the hour hand and the necessity of the date indicator driving extremely easily based on whether or not the regions "3" and "4" whose boundary is the 12 o'clock (midnight) position are included between the start position holding register value and the stop position holding register value. Specifically, in the case of the route "i", the hour hand moves from "1" to "4" and beyond the hour hand detection regions "3" and "4" corresponding to the 12 o'clock (midnight) position and hence the date indicator driving is performed, and, in the route "ii", the hour hand moves from "6" to "4", and this movement does not correspond to the date indicator driving condition and hence the date indicator driving is not performed.

[2] Description of Movement Pattern C4

The hour hand movement pattern of the column D1 in FIGS. 9C and 9D illustrates the case where the hour hand moves from the zone A or the zone B to the zone C and stops in the region "0".

In the example of the hour hand movement of the column D2, the hour hand moves from the hour hand detection regions "2" to "0". In the route "i", the hour hand detection region changes in the order of "2", "3", "4", "5", "6", and "0". In the route "ii", the hour hand detection region changes in the order of "2", "1", and "0". In the route "i", the hour hand moves beyond the 12 o'clock (midnight) position and hence the date indicator driving is necessary. In the route "ii", the date indicator driving is unnecessary.

In FIG. 9C, the region "0" processing is not performed, and hence, similarly to the example illustrated in FIG. 9A, as indicated by the register values of the columns D5 and D6, the start position holding register value and the stop position holding register value are identical in the route "i" and the route "ii", and hence the rotation direction cannot be discriminated.

In FIG. 9D, by performing the above-mentioned processing on the region "0", in the route "i", the start position holding register value holds "2", and the stop position holding register value holds the region "6" that is a region just before the region "0" at which the hour hand has stopped. On the other hand, in the route "ii", the start position holding register value holds "2", and the value of the stop position holding register becomes the region "1" that is a region just before the region "0" at which the hour hand has stopped. Thus, the CPU 3 performs the date indicator driving in the case of the route "i" because the hour hand moves from the detection region "2" to the detection region "6" and beyond the hour hand detection regions "3" and "4" corresponding to the 12 o'clock (midnight) position, but does not perform the date indicator driving in the case of the route "ii" because the hour hand moves from the detection region "2" to the detection region "1" and this movement does not correspond to the date indicator driving condition. Descriptions of the other cases are omitted because the operations overlap with those in the above-mentioned case. In any case, the date indicator driving processing can be performed easily and accurately by the above-mentioned processing method for the region

Specific Description of the Second Embodiment

Figure 10:
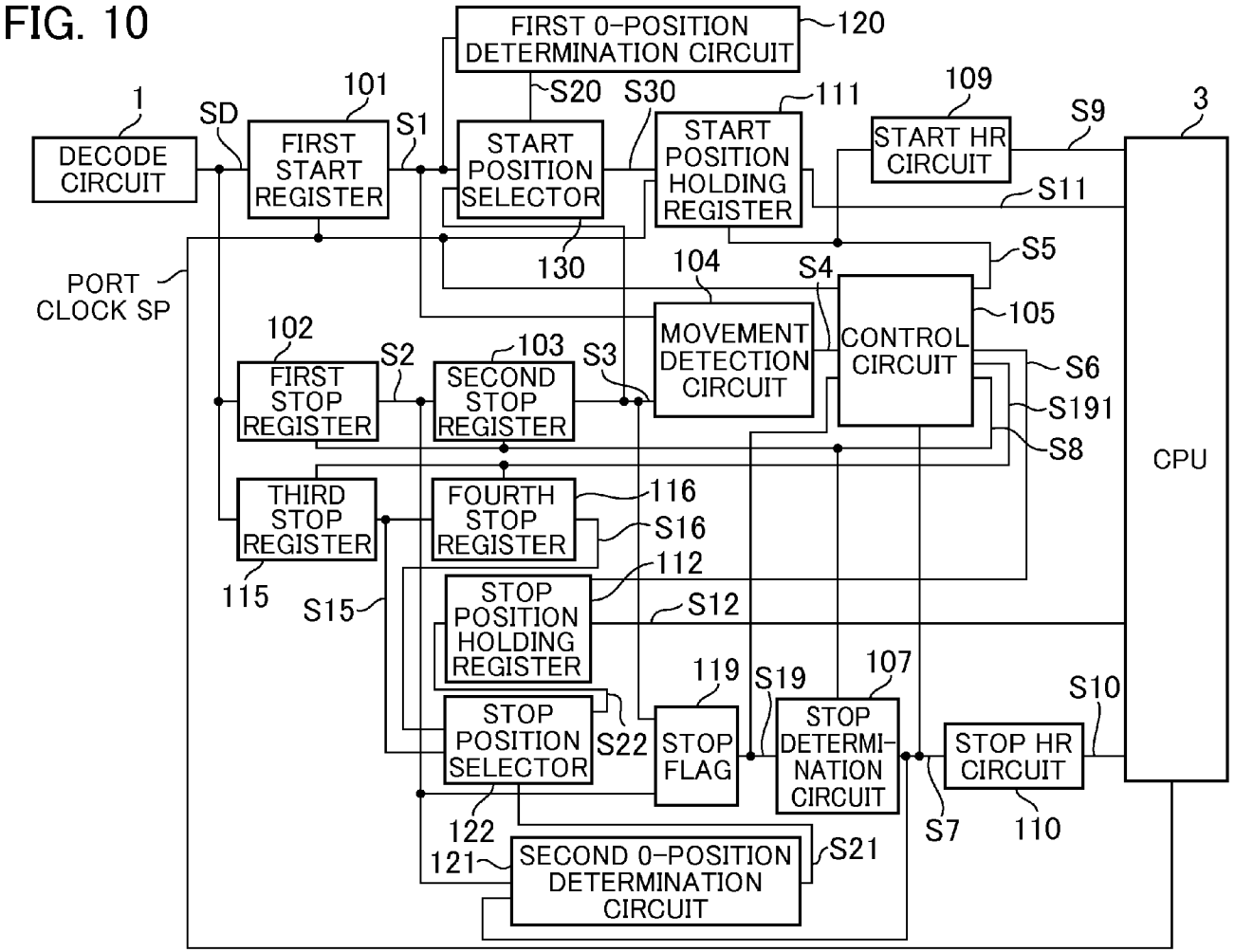
FIG. 10 is a block diagram of a hand position information circuit according to a second embodiment of the present invention.

FIG. 10 is a block diagram illustrating an exemplary hand position information circuit 2 according to the second embodiment.

The feature of the circuit configuration according to the second embodiment resides in that a circuit for performing the above-mentioned processing on the region "0" shown in FIGS. 9B and 9D is added to the circuit of the first embodiment.

[Basic Operation]

First and second 0-position determination circuits 120 and 121, each being a circuit for determining whether or not the position of the hour hand is in the region "0", are provided in the start circuit 150 and the stop circuit 151, respectively, so as to detect the movement start from the region "0" and the stop in the region "0".

When the movement start from the region "0" is detected, as described with reference to FIGS. 9B and 9D, the data on the region next to the region where the hour hand has started to move needs to be set as data of the start position holding register 111.

As described above, the first and second stop registers 102 and 103 do not operate until the detection of the movement start of the hour hand 203 is detected, and hence the second stop register 103 stores data on a region where the hour hand 203 has stopped last time, that is, data on a region where the hour hand 203 has started to move this time. At the timing when the movement of the hour hand 203 is detected, data on a region next to the region where the hour hand has started to move is held in the first start register 101. Thus, when the hour hand 203 starts to move from the region "0", the data to be fetched into the start position holding register 111 is switched from the data on the region where the hour hand 203 has started to move to the data on the next region, and is held as start position holding data. Based on this data, the date indicator driving processing is performed by the CPU 3.

When the hour hand 203 has started to move and stopped in the region "0", a region before the hour hand has moved to the region "0" needs to be set as the data of the stop position holding register, and hence the registers for storing region data upon the change in region data output from the decode circuit 1 are provided as third and fourth stop registers 115 and 116. In this manner, data on a region where the hour hand 203 is currently located is held in the third stop register 115, and data on the previous region is held in the fourth stop register 116. Thus, when the hour hand has stopped in the region "0", the data on the previous region is selected and held in the stop position holding register 112, and the date indicator driving processing can be performed by the CPU 3 based on this data.

When the hour hand has started to move and passed the region "0", the same region data lasts for a while. In view of this, the stop determination circuit is configured to determine that the movement of the hour hand has stopped during the passage through the region "0", and the processing for the case where the hour hand has stopped in the region "0" is performed. Subsequently, the hour hand moves from the region "0" to the next region, and hence the above-mentioned processing for the case where the movement start from the region "0" has been detected is performed. The processing for the case where the hour hand has passed the region "0" is described later. The above is the operation characteristic to the second embodiment.

Circuit Configuration in the Second Embodiment

The hand position information circuit 2 includes, in addition to the circuits of FIG. 5, a first 0-position determination circuit 120, a second 0-position determination circuit 121, a start position selector 130, a third stop register 115, a fourth stop register 116, and a stop position selector 122. The other circuit configurations are the same, and hence the same configurations as those described above are denoted by the same reference numerals and the description thereof is omitted.

The difference between the circuits illustrated in FIG. 5 and FIG. 10 is described below. The output S1 of the first start register 101 and the output S3 of the second stop register 103 are input to the start position selector 130, and an output S30 of the start position selector 130 is input to the start position holding register 111. The output S1 of the first start register 101 is also input to the first 0-position determination circuit 120. The first 0-position determination circuit 120 determines the input value of S1, and outputs a control signal S20 that takes "1" when the value of S1 is "0" and takes "0" otherwise. S20 is input as a control line of the start position selector 130. The input of the start position selector 130 is selected by the output S20 of the first 0-position determination circuit, and the start position selector 130 selects S1 when S20 is "1" and S3 when S20 is "0", and outputs the selected signal to the start position holding register 111.

The output S2 of the first stop register 102 is input to the stop flag circuit 119 and the second 0-position determination circuit 121. The output S7 of the stop determination circuit 107 is input to the control circuit 105, the stop HR circuit 110, and the second 0-position determination circuit 121. The output SD of the decode circuit 1 is input to the first start register 101, the first stop register 102, and the third stop register 115. The output S15 of the third stop register is input to the fourth stop register 116 and the stop position selector 122. The output S16 of the fourth stop register is also input to the stop position selector 122. The input of the stop position selector 122 is selected by the output S21 of the second 0-position determination circuit 121, and the second 0-position determination circuit 121 selects and outputs S16 when S21 is "1", and selects and outputs S15 when S21 is "0". The output S21 of the second 0-position determination circuit 121 is set to be "1" when the input value of S2 is determined to be "0", and set to be "0" otherwise.

The output S191 of the control circuit is input to the third stop register 115 and the fourth stop register 116. In response to S191, the third stop register 115 and the fourth stop register 116 hold and output the respective input data. The configurations other than the parts described above are the same as those of FIG. 5, and the operations thereof are also the same.

Description of the Operation in the Second Embodiment

Figure 11:
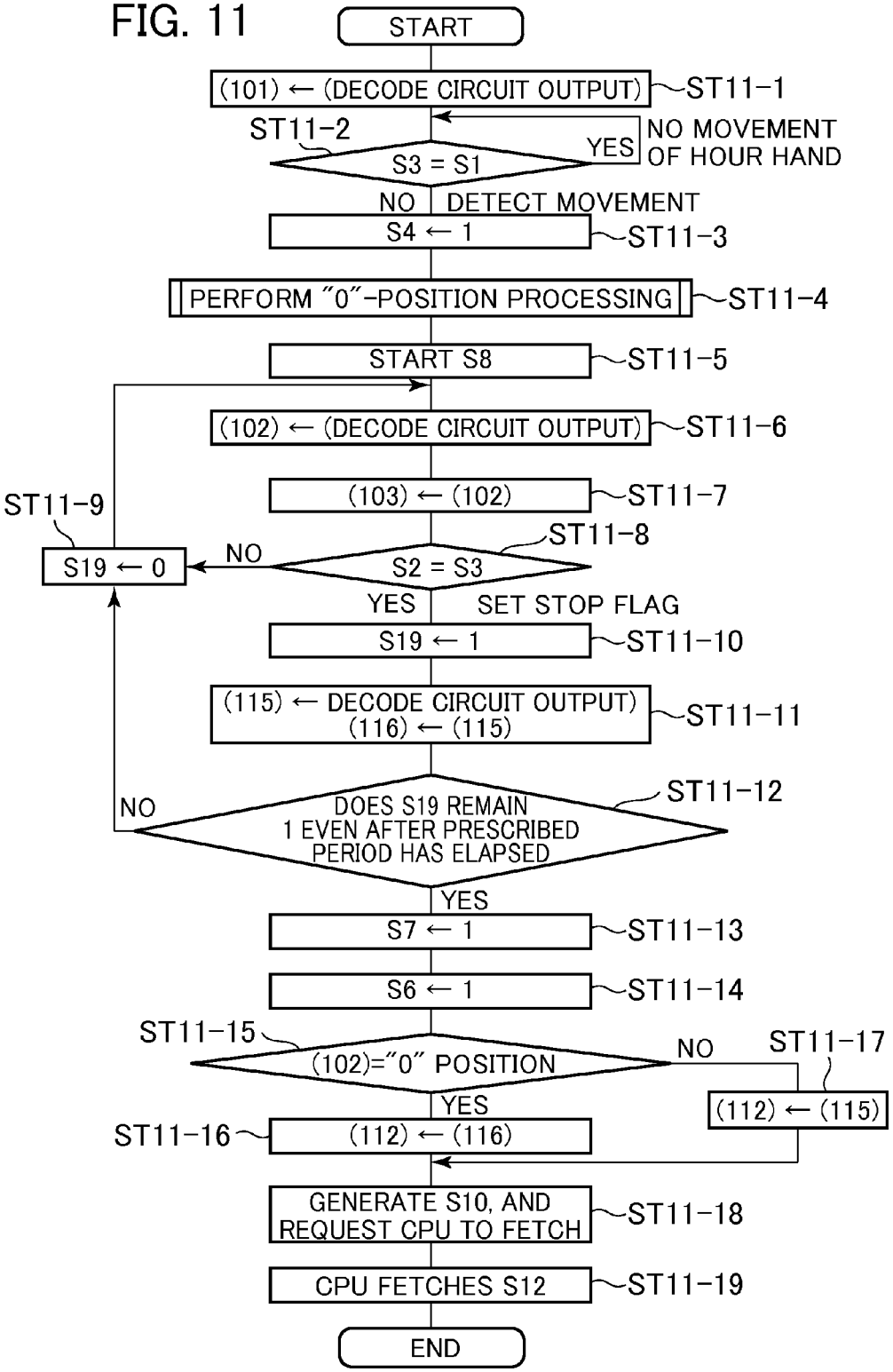
FIG. 11 is a flow chart illustrating a main routine of the hand position information circuit according to the second embodiment of the present invention.
Figure 12:
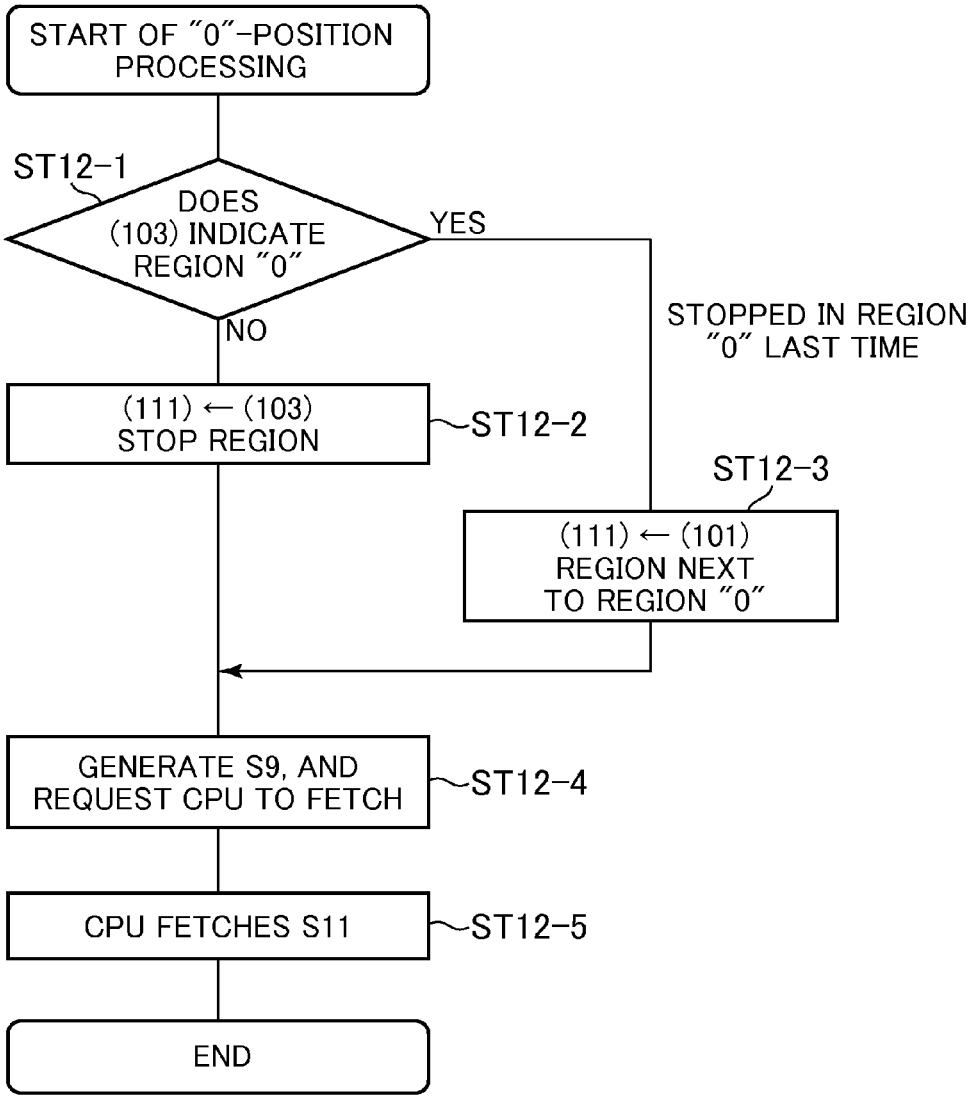
FIG. 12 is a flow chart illustrating a sub-routine illustrating details of "0" region processing on a start position performed by the hand position information circuit according to the second embodiment of the present invention.

Next, the circuit operation of the hand position information circuit 2 according to the second embodiment illustrated in FIG. 10 is described with reference to flow charts of FIGS. 11 and 12. FIG. 11 illustrates a main routine, and FIG. 12 illustrates a sub-routine illustrating the details of the "0"-region processing of the start position.

[1] Acquisition of the Movement Start Region of the Hour Hand

The first start register 101 holds the region data output from the decode circuit 1 at a change timing of the port clock SP (ST11-1). The movement detection circuit 104 compares the output S1 of the first start register 101 and the output S3 of the second stop register 103 (ST11-2). When the pieces of the region data are different from each other (ST11-2: NO), the movement detection circuit 104 determines that the hour hand 203 has started to move, and generates S4 (ST11-3). When S1 and S3 are equal to each other (ST11-2: YES), the movement detection circuit 104 continues to compare S1 and S3 because there is no movement of the hour hand 203. In this case, the output S3 of the second stop register 103 is region data acquired when the hour hand moved to stop last time. The operation described above is the same as in the first embodiment.

[2] Movement Start Region Processing for the Region "0"

After the generation of S4 indicating the detection of the movement start, a region "0" determination for the movement start position is performed (ST11-4). A description is now given with reference to FIG. 12.

The first 0-position determination circuit 120 determines whether or not the output S1 of the first start register 101 is data on the region "0" (ST12-1). When the output S1 is data on the region "0" (ST12-1: YES), the first 0-position determination circuit 120 sets S20 to "1", and otherwise (ST12-1: NO), sets S20 to "0", and outputs S20 to select input data of the start position selector 130. When S20 is "1" (ST12-1: YES), the output S1 of the first start register 101 indicating data on the region at which the hour hand arrives next to the region "0" is selected (ST12-3), and is held in the start position holding register 111. When S20 is "0" (ST12-1: NO), the output S3 of the second stop register 103 indicating the region from which the hour hand has started to move is held in the start position holding register 111 (ST12-2).

In response to the generation of S5 for operating the start position holding register 111, the start HR circuit 109 generates S9 to prompt the CPU 3 to acquire the data (ST12-4), and the CPU 3 fetches the region data S11 of the start position holding register 111 (ST12-5).

[3] Acquisition of the Stop Region of the Hour Hand

Returning to FIG. 11 again, in response to the generation of S4 indicating the movement start detection of the hour hand 203, the control circuit 105 generates the clock S8 (ST11-5). At the change timing of S8, the control circuit 105 holds the region data SD of the decode circuit output 1 in the first stop register 102 (ST11-6), and simultaneously holds the output S2 of the first stop register 102 in the second stop register 103 (ST11-7).

The stop flag circuit 119 compares S2 and S3, which are respectively the outputs of the first stop register 102 and the second stop register 103 (ST11-8). When the outputs are equal to each other (ST11-8: YES), the stop flag circuit 119 sets S19 to "1" (ST11-10). When the outputs are not equal to each other (ST11-8: NO), the stop flag circuit 119 sets S19 to "0" (ST11-9).

The control circuit 105 generates the clock signal S191 in accordance with the switching of the stop flag S19 from "0" to "1", and inputs the clock signal S191 to the third stop register 115 and the fourth stop register 116 to permit the acquisition of the respective pieces of input data. Thus, if the data held by the third stop register is a detection region where the hour hand is currently located, data on a previous detection region is held in the fourth stop register (ST11-11).

When S19 is continuously generated for a predetermined period of time (ST11-12: YES), the stop determination circuit 107 determines that the hour hand 203 has stopped, and S7 becomes "1" (ST11-13). In response to the generation of S7 indicating the stop of the hour hand, the control circuit 105 sets S6 to "1" (ST11-14), and the stop position holding register 112 holds region data selected by the stop position selector 122.

[4] Stop Processing for the Region "0"

The second 0-position determination circuit 121 determines whether or not the output S2 of the first stop register 102 is data on the region "0" (ST11-15), and inputs the determination signal S21 to the stop position selector 122. When S21 is "1" (ST11-15: YES), the stop position selector 122 selects the output S16 of the fourth stop register 116 indicating the data on the previous detection region (ST11-16). When S21 is "0" (ST11-15: NO), the stop position selector 122 selects the output S15 of the third stop register 115 indicating the data on the detection region where the hour hand is currently located (ST11-17). In response to the generation of S7 indicating the stop determination, the stop HR circuit 110 generates S10 to prompt the CPU 3 to acquire the region data (ST11-18), and the CPU 3 fetches the region data S12 of the stop position holding register 112 (ST11-19). The CPU 3 sequentially acquires the output S11 of the start position holding register 111 and the output S12 of the stop position holding register 112, and determines that the hour hand has moved beyond the 12 o'clock (midnight) position.

The first stop register 102 and the second stop register 103 have the role of detecting the stop of the hour hand 203, and hence fetch new region data SD until the stop determination is confirmed by the stop flag circuit 119 (S19, "1"). Thus, the first stop register 102 and the second stop register 103 cannot hold the region data corresponding to the stop position at the timing when S191 is generated, and hence the third stop register 115 and the fourth stop register 116 are provided for holding the region data.

Figure 13:
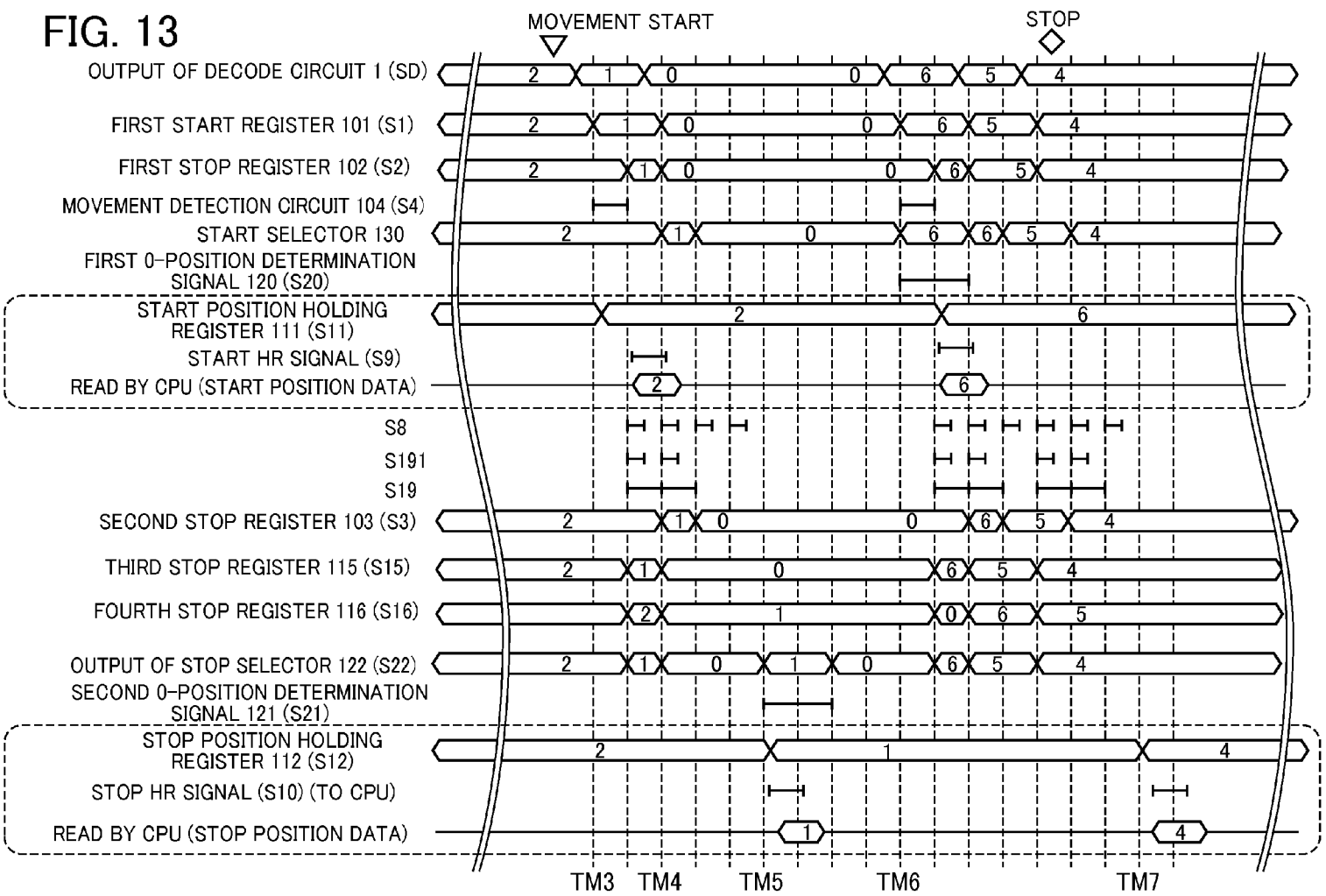
FIG. 13 is a time chart illustrating an operation of the hand position information circuit according to the second embodiment of the present invention.

FIG. 13 illustrates the operation of the hand position information circuit 2 shown in FIG. 10 in the form of a time chart, illustrating the flow of data in time series. Note that, the time range marked with a line indicates an active "1", and the time range not marked with a line indicates a negative "0".

At a timing TM3 in FIG. 13, the region data of the first start register 101 and the region data of the first stop register 102 are different from each other, and hence the output S4 of the movement detection circuit 104 becomes "1". At this time, the output S2 of the first start register 101 is "2", and hence the start position selector 130 outputs the output S2 of the first start register 101. The region data "2" of the second stop register output from the start position selector 130 is held in the start position holding register 111, and is read by the CPU 3.

Next, at TM4, the hour hand is located in the region "0", and hence the first stop register 102 becomes "0" and the second stop register 103 also becomes "0" after one clock. Then, the stop flag circuit 119 becomes "1". It is determined that the hour hand has stopped because the stop flag circuit 119 continues to output "1" for a predetermined period of time. However, because the region data of the first stop register 102 is "0", the output of the second 0-position determination circuit 121 switches the stop position selector 122 to the fourth stop register 116 side at a timing TM5, and the region before the hour hand moves to the region "0" is held in the stop position holding register 122 and read by the CPU 3.

The hour hand still continues to move thereafter, and the region data of the first start register 101 changes from "0" to "6". Thus, the movement detection circuit 104 determines that the hour hand has started to move. However, the first 0-position determination circuit determines that the hour hand has started to move from the region "0", and hence, at a timing TM6, the data S1 of the first start register 101 is selected and held in the start position holding register 111, which is then read by the CPU 3.

The hour hand further continues to move, and stops in the region "4". Then, because the stop flag is generated for a predetermined period of time or longer, the stop determination circuit 107 determines that the hour hand has stopped, selects the third stop register 115 serving as the current region data, and holds the region data in the stop position holding register 112, which is read by the CPU 3.

First Modified Example of the Second Embodiment

Figure 14:
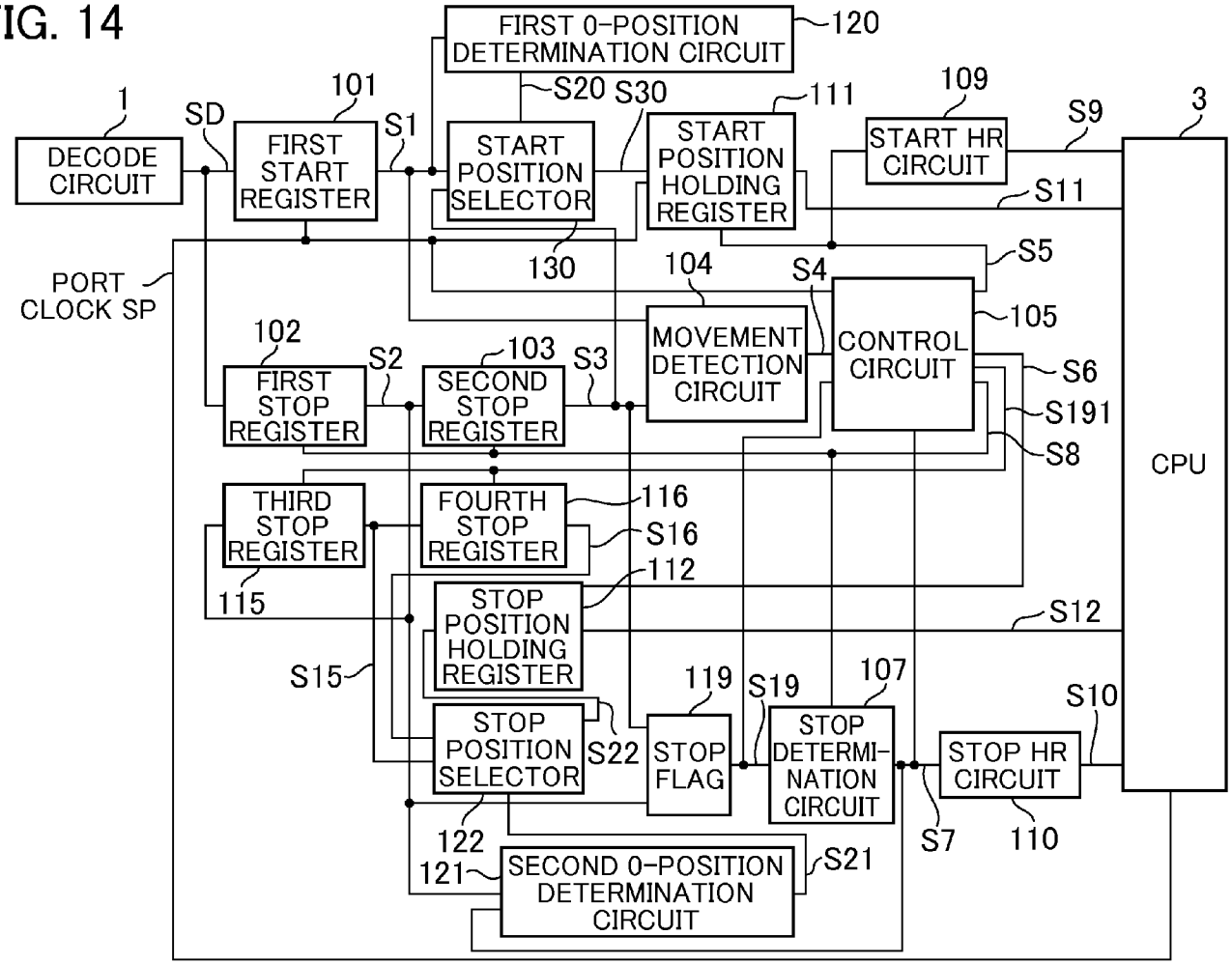
FIG. 14 is a block diagram illustrating a hand position information circuit according to a first modified example of the second embodiment of the present invention.

FIG. 14 is a modified example of FIG. 10, and the difference from FIG. 10 resides in that the input of the third stop register 115 is the output of the first stop register 102. In this way, the third stop register 115 holds the output of the first stop register 102 that has already been synchronized with the port clock SP, and hence, when the output of the decode circuit 1 that operates in asynchronization with the hand position information circuit 2 is to be held, it is possible to prevent metastability that occurs when the clock and the data simultaneously change, thus further improving the certainty of the processing.

Second Modified Example of the Second Embodiment

Figure 15:
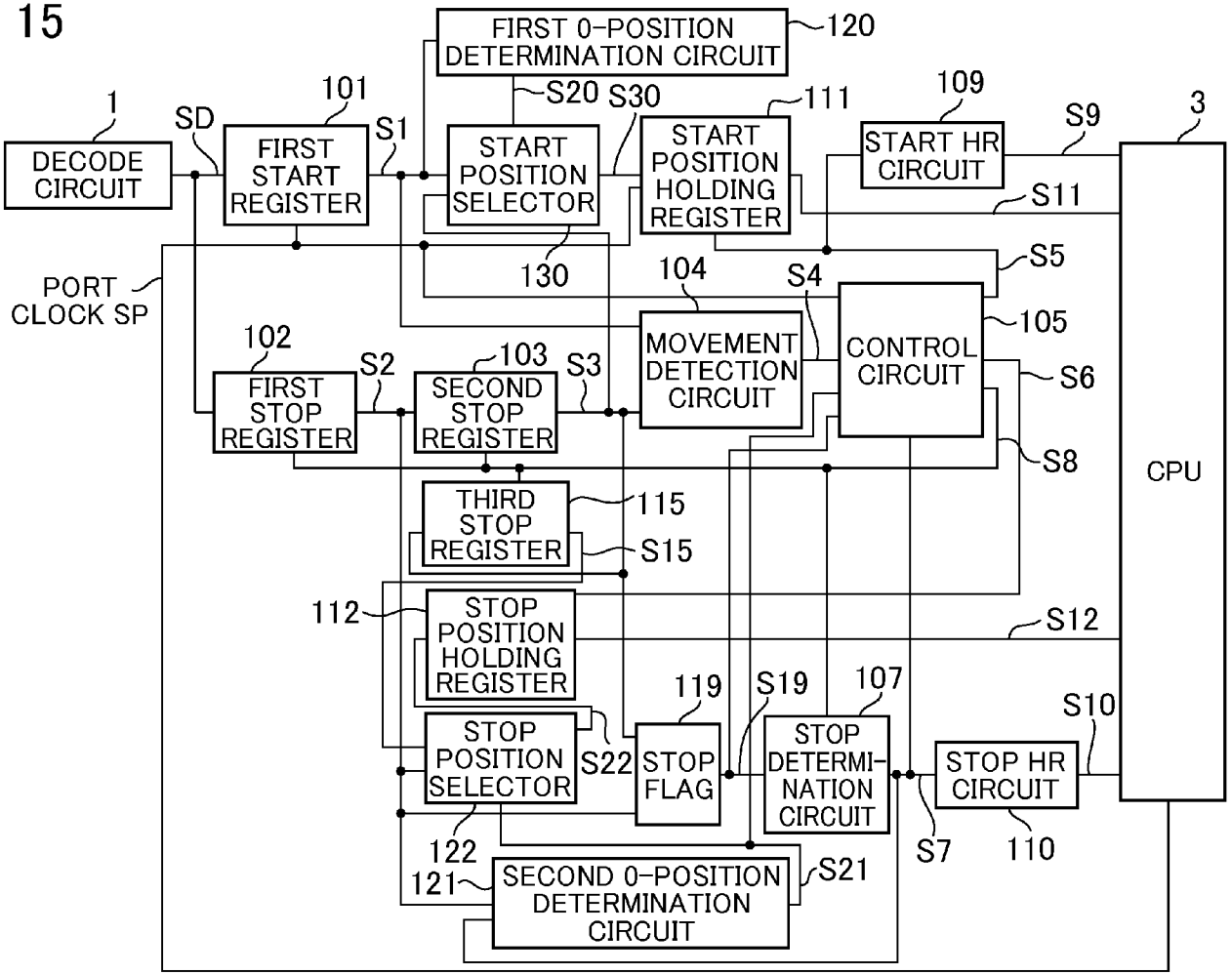
FIG. 15 is a block diagram illustrating a hand position information circuit according to a second modified example of the second embodiment of the present invention.

FIG. 15 is a second modified example of FIG. 10. The difference from FIG. 10 resides in that the first, second, and third stop registers all operate with S8 being the clock and that the input signals of the stop position selector 122 select the first stop register 102 and the third stop register 115.

The third stop register 115 holds the output S3 of the second stop register 103, with the output S8 of the control circuit 105 used as the clock. Then, the output S2 of the first stop register 102 and the output S15 of the third stop register 115 are input to the stop position selector 122. The stop position selector 122 selects S15 when the output S21 of the second 0-position determination circuit 121 is "1", and selects S2 when S21 is "0", and then outputs the selected signal to the stop position holding register 112.

Operation in the Second Modified Example of the Second Embodiment

The first, second, and third stop registers 102, 103, and 115 form a shift register, and hold the region data SD output from the decode circuit 1 in a serial manner. Both the outputs of the first and second stop registers 102 and 103 are compared with each other by the stop flag circuit 119. When the outputs match with each other, the stop flag S19 is generated. When the generation of S19 continues for a predetermined period of time, the stop circuit 107 generates the stop determination S7.

In response to the generation of S7, the second 0-position determination circuit 121 selects the input of the selector 122 depending on whether or not the output S2 of the first stop register 102 is the region "0" data. Specifically, when the second 0-position determination circuit 121 detects that the region data of S2 is the region "0" data, the selector 122 selects the output S15 of the third stop register 115 indicating the data on the region where the hour hand has been located before the hour hand enters the region "0". Then, the control circuit 105 generates S6 to fetch the region data S15 into the stop position holding register 112.

When the region data of S2 is not the region "0" data, the stop position selector 122 selects S2 indicating the data on the region where the hour hand is currently located. Then, the control circuit 105 generates S6 to fetch the region data S2 into the stop position holding register 112. Note that, in this case, the second 0-position determination circuit 121 selects the input of the selector 122 in response to the generation of S7, but the second 0-position determination circuit 121 may select the input of the selector 122 always depending on whether or not S2 is the region "0" data irrespective of the generation of S7. The other operations than the above are the same as the operations described with reference to FIG. 8.

Third Embodiment

Figure 16:
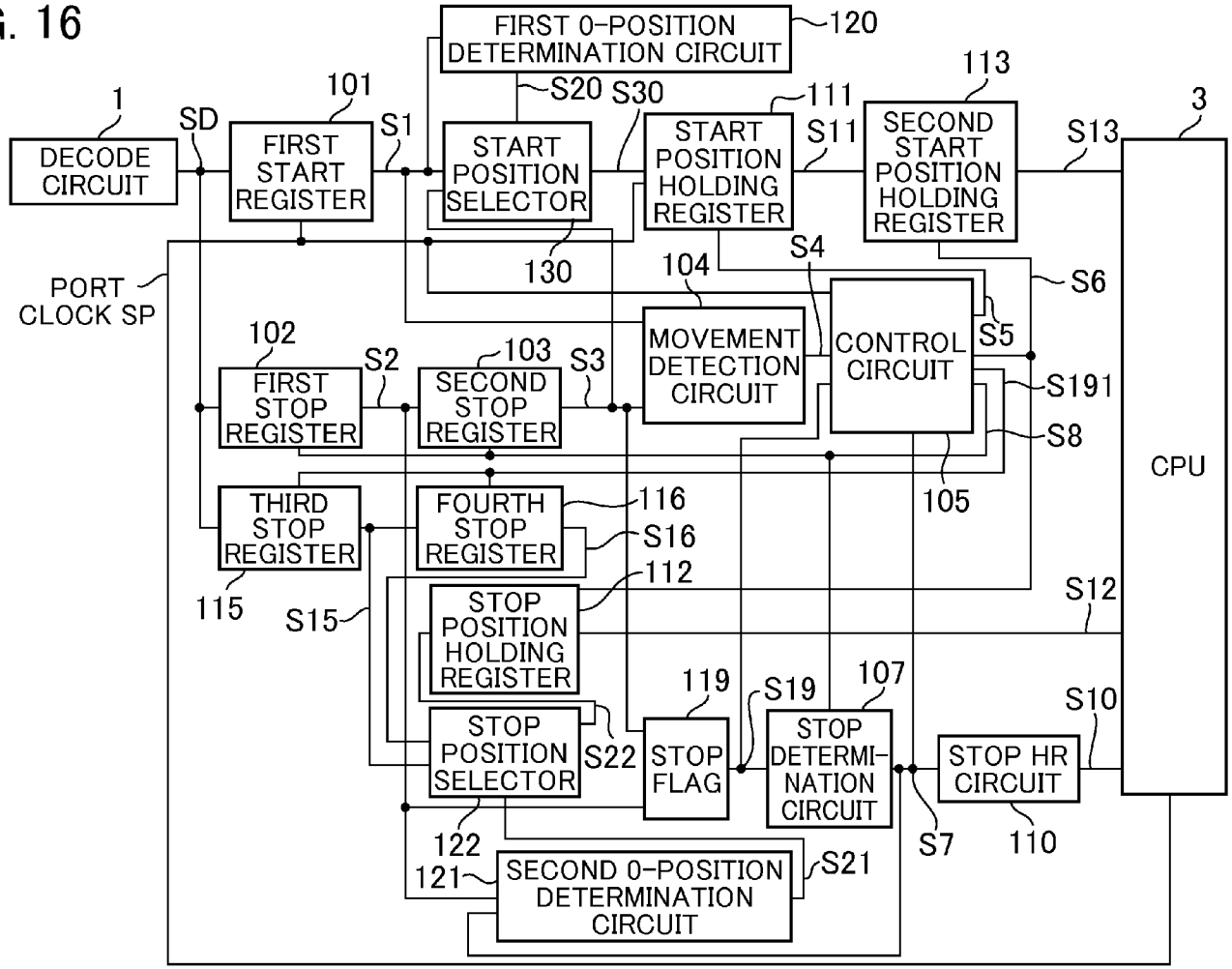
FIG. 16 is a block diagram of a hand position information circuit according to a third embodiment of the present invention.

FIG. 16 illustrates a circuit configuration according to a third embodiment of the present invention. The difference from FIG. 10 resides in that the start HR circuit 109 is deleted and a second start position holding register 113 is added.

Even after entering the mode for correcting the hour hand, the CPU 3 performs the processing relating to the counting. When the CPU 3 receives the start HR signal S9 or the stop HR signal S10 described above from the hand position information circuit 2, the CPU 3 interrupts the current processing and preferentially performs processing of reading the start position holding register 111 or the stop position holding register 112 from the hand position information circuit 2. Thus, in order for the CPU 3 to efficiently perform the processing, it is desired that the number of processing interruptions by HR be small.

In the third embodiment, the start HR and the stop HR are not prepared separately, but the stop HR is used to read the region data of the start position holding register and the stop position holding register into the CPU 3. This requires only one processing interruption by HR and a smaller number of signal lines for HR.

The second start position holding register 113 inputs the output S11 of the start position holding register 111, and in response to the output S6 of the control circuit 105, stores the data of S11 and outputs the data to the CPU 3. S6 is the signal for controlling the stop position holding register 112 to hold stop region data of the hour hand. At the same timing as in the stop position holding register 112, the second start position holding register 113 holds the output S11 of the start position holding register 111.

Operation in the Third Embodiment

In the example illustrated in FIG. 10, the movement start region data of the hour hand is held in the start position holding register 111. In the example illustrated in FIG. 16, however, at the same timing when the movement stop region data is held in the stop position holding register 112 in response to the movement stop detection of the hour hand, the movement start region data is fetched from the start position holding register 111 into the second start position holding register 113, and the acquisition request signal S10 for the region data is issued from the stop HR circuit 110 to the CPU 3. After that, the CPU 3 reads the data of the second start position holding register 113 and the stop position holding register 112 to perform the date indicator driving processing. The other operations than the above are the same as those described above with reference to FIG. 10. With this configuration, even if the movement of the hour hand 203 is restarted by a user's operation while the CPU 3 is reading the movement start region data and the movement stop region data described above, the movement start region data before the restart of movement can be held in the second start position holding register 113 and transferred to the CPU 3, and further the movement start region data at the time when the hour hand is moved again can be held in the start position holding register 111. Consequently, even if the user moves the hour hand again in the hour hand correction, the operational intension can be reflected to improve the convenience. In addition, the number of control lines used for communications between the CPU 3 and the hour hand position information circuit can be reduced, and further, the acquisition of the region data can be limited to one timing and hence the processing of the CPU 3 does not need to be interrupted frequently and the efficiency can be improved.

Figure 17:
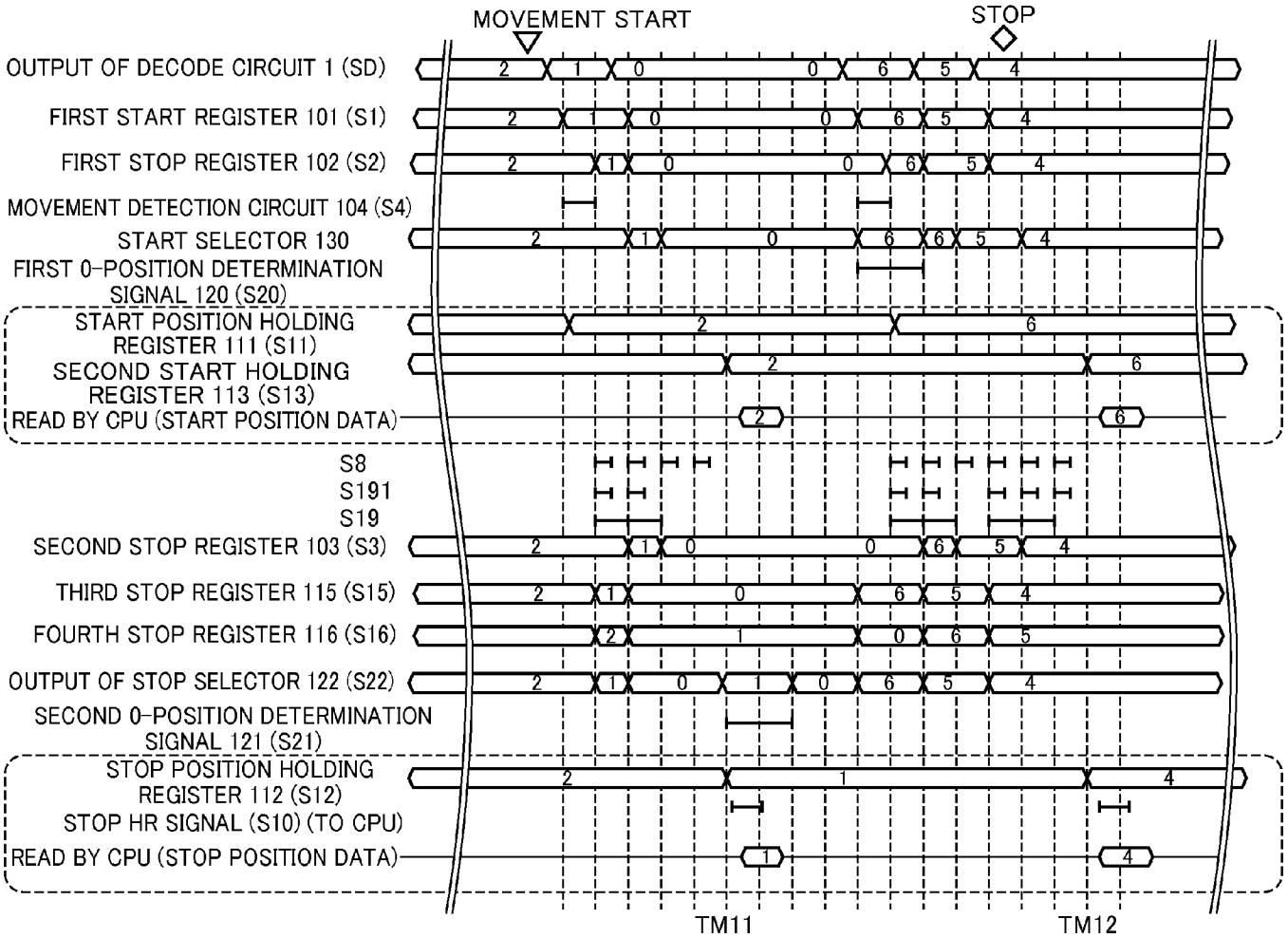
FIG. 17 is a time chart illustrating an operation of the hand position information circuit according to the third embodiment of the present invention.

FIG. 17 is a time chart illustrating the flow of data of FIG. 16 in time series. At TM11 and TM12, the stop region data of the hour hand is held in the stop position holding register 112 and is read by the CPU 3, but at the same timings, the data of the start position holding register 111 is read into the second start position holding register 113. Thus, the CPU 3 can read the data of the start position and the stop position at once.

[Stop Determination Circuit]

Figure 18:
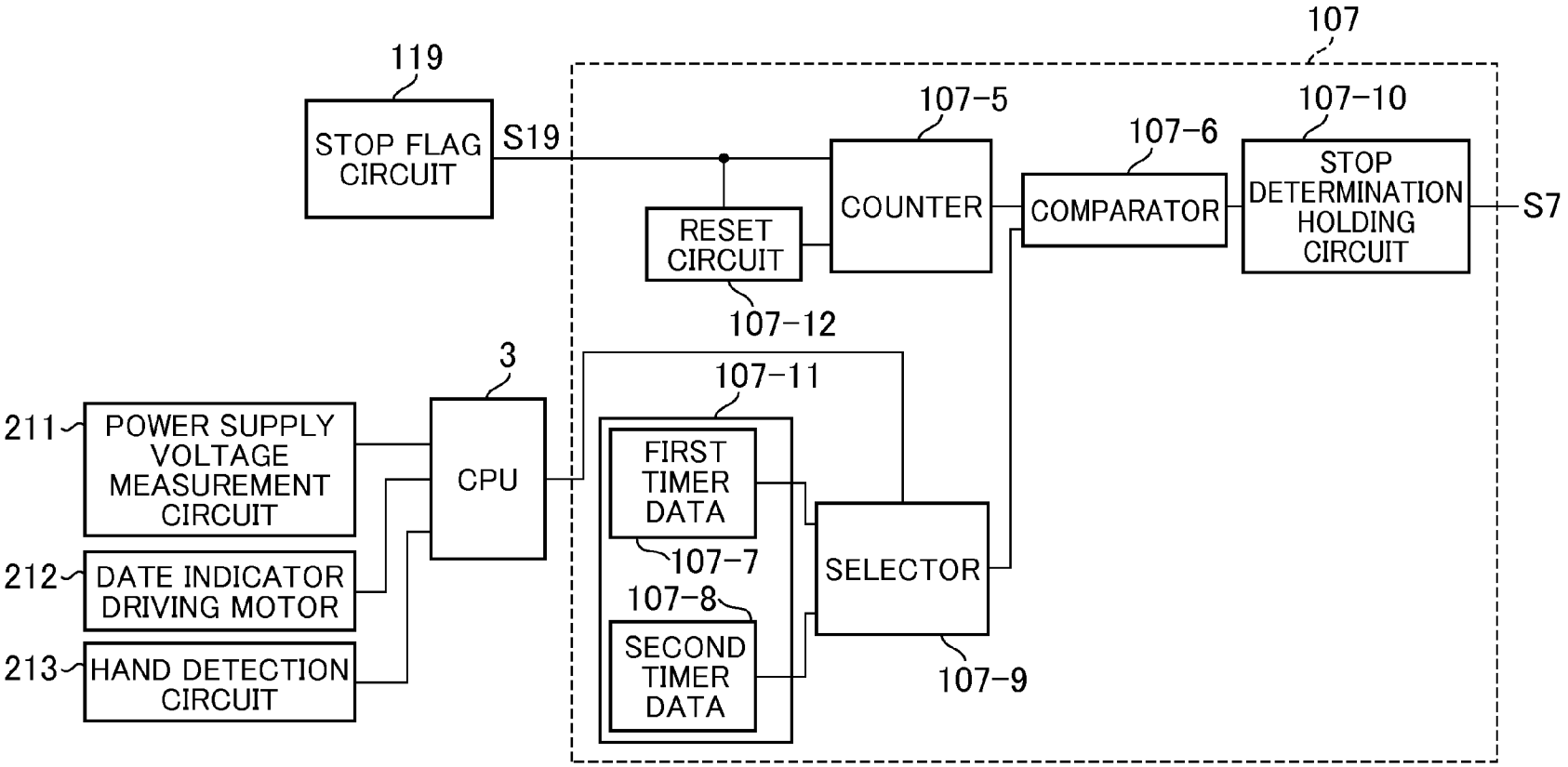
FIG. 18 is a block diagram illustrating an exemplary stop determination circuit in each embodiment of the present invention.

FIG. 18 is an example of the stop determination circuit 107 illustrated in FIGS. 5, 10, 14, 15, and 16.

The stop determination circuit 107 is a circuit for determining that the movement of the hour hand has stopped when the region data output from the decode circuit remains unchanged for a predetermined period of time. The stop determination circuit 107 includes a timer for measuring a period during which the pieces of region data match with each other. As timer values, first timer data indicating a normal determination time and second timer data indicating a determination time longer than the first timer data are prepared. When the second timer data is selected, the time required for determining the stop of the hour hand becomes longer, and hence it is not determined that the hour hand has stopped even when the hour hand has stopped for a short time. Thus, even if a short stop occurs when the user is moving the hour hand, unnecessary date indicator driving processing is not performed. Changing the calendar display by the date indicator driving processing consumes large power, and hence, by selecting the second timer data under the condition to be described later such as a low power supply voltage, the frequency of the wasted date indicator driving processing can be reduced.

The stop determination circuit 107 includes a reset circuit 107-12, a counter 107-5, a comparator 107-6, a stop determination holding circuit 107-10, a storage unit 107-11 for storing first timer data 107-7 and second timer data 107-8, and a selector 107-9.

The output S19 of the stop flag circuit 119 is input to an enable of the counter 107-5 and the reset circuit 107-12, an output of the reset circuit 107-12 is input to a reset of the counter 107-5, and an output of the counter 107-5 is input to the comparator 107-6.

An output of a power supply voltage measurement circuit 211 is input to the CPU 3, and a date indicator driving motor 212 is driven by a drive signal output from the CPU 3. The storage unit 107-11 stores the first timer data 107-7 and the second timer data 107-8. The timer data is selected by the selector 107-9 in response to a control signal of the CPU 3, and is input to the comparator 107-6. The output of the comparator 107-6 is input to the stop determination holding circuit 107-10, and the output of the stop determination holding circuit 107-10 is input to the stop HR circuit 110, the control circuit 105, and the second 0-position determination circuit 121 as S7.

[Operation of the Stop Determination Circuit]

Next, a description is given of the operation of the stop determination circuit 107 illustrated in FIG. 18. In this case, first, a description is given of the output signal S19 of the stop flag circuit 119 in the hand position information circuit 2 of FIG. 10.

When the movement detection circuit 104 illustrated in FIG. 10 detects the movement of the hour hand, S8 is generated and the first stop register 102 and the second stop register 103 hold the region data output from the decode circuit 1 in a serial manner. The first stop register and the second stop register are shift registers that operate with a common clock. When position region data of the output of the decode circuit has changed, the value of the first stop register and the value of the second stop register differ from each other by one clock. When there is no change, the values are identical to each other.

The stop flag circuit 119 compares the first stop register 102 and the second stop register 103 to detect that the pieces of position region data match with each other, and the stop flag S19 continues to output "1" as long as the stop register 1 and the second stop register have the same value.

Figure 20:
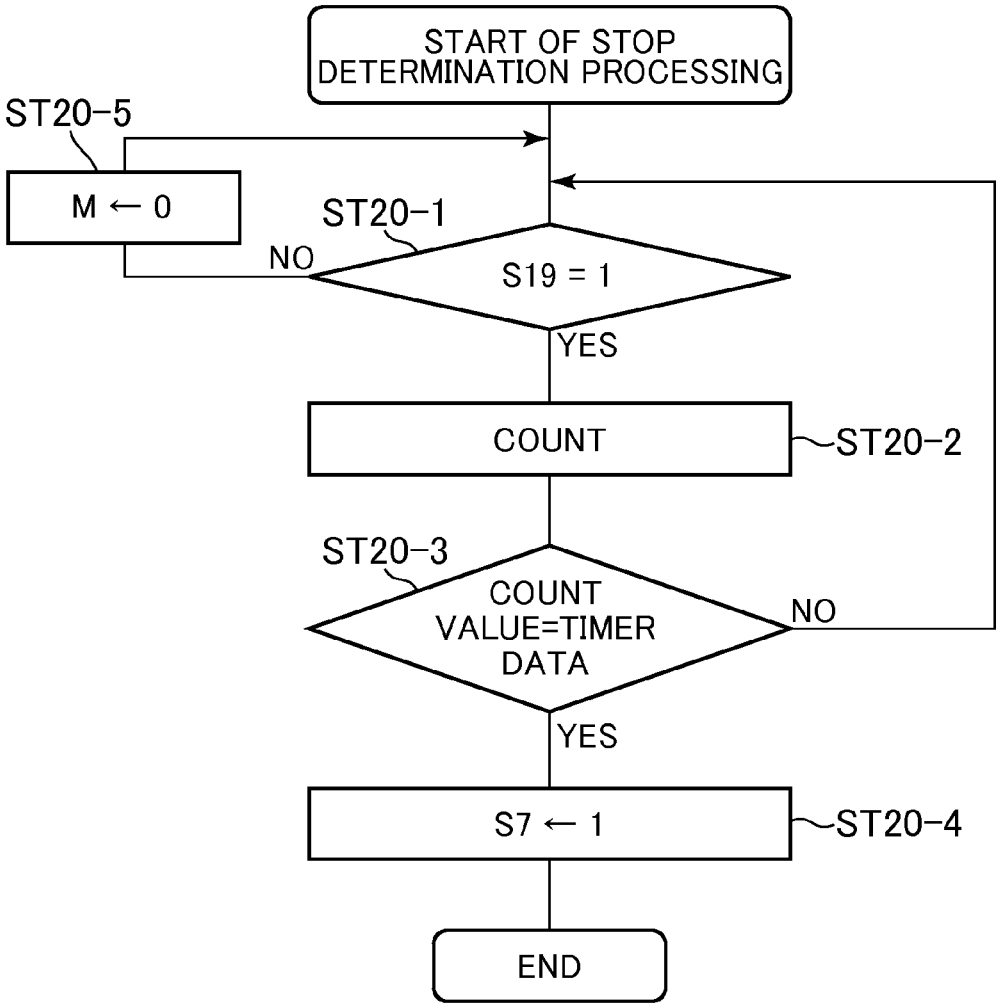
FIG. 20 is a flow chart illustrating details of processing of the stop determination circuit in each embodiment of the present invention.

Next, a description is given of the operation of the stop determination circuit 107 with reference to a flow chart of FIG. 20. It is determined whether or not S19 of the stop flag circuit is "1", that is, whether or not the hour hand is brought into the stop state (ST20-1). When S19 is "1" (ST20-1: YES), the counter 107-5 executes the counting (ST20-2). Note that, the specific configuration of the counter 107-5 and the clock for counting are not essential parts of the present invention and are therefore omitted, but may be freely selected as long as the present invention can be realized.

Next, a timer value preset in the storage unit 107-11 and the value of the counter 107-5 are compared to each other (ST20-3), and, when those values become equal to each other (ST20-3: YES), it is determined that the hour hand has stopped, and S7 is generated (ST20-4). Note that, when S19 is "0" (ST20-1: NO), the counter 107-5 is cleared by the reset circuit 107-12, and the stop of the hour hand is continued (ST20-5).

In the storage unit 107-11, a plurality of pieces of timer setting data are prepared. The first timer data 107-7 sets a normal stop determination time, and the second timer data 107-8 sets a stop determination time longer than the first timer data. The longer stop determination time as used herein refers to a period that is 1.5 times to 2 times the normal stop determination time, for example. The normal stop determination time as used herein refers to a period suitable for the stop determination that is acquired based on the rotation speed of the hour hand in the correction operation or the clock frequency of the hand position information circuit 2.

[Selection Condition of the Second Timer]

Figure 21:
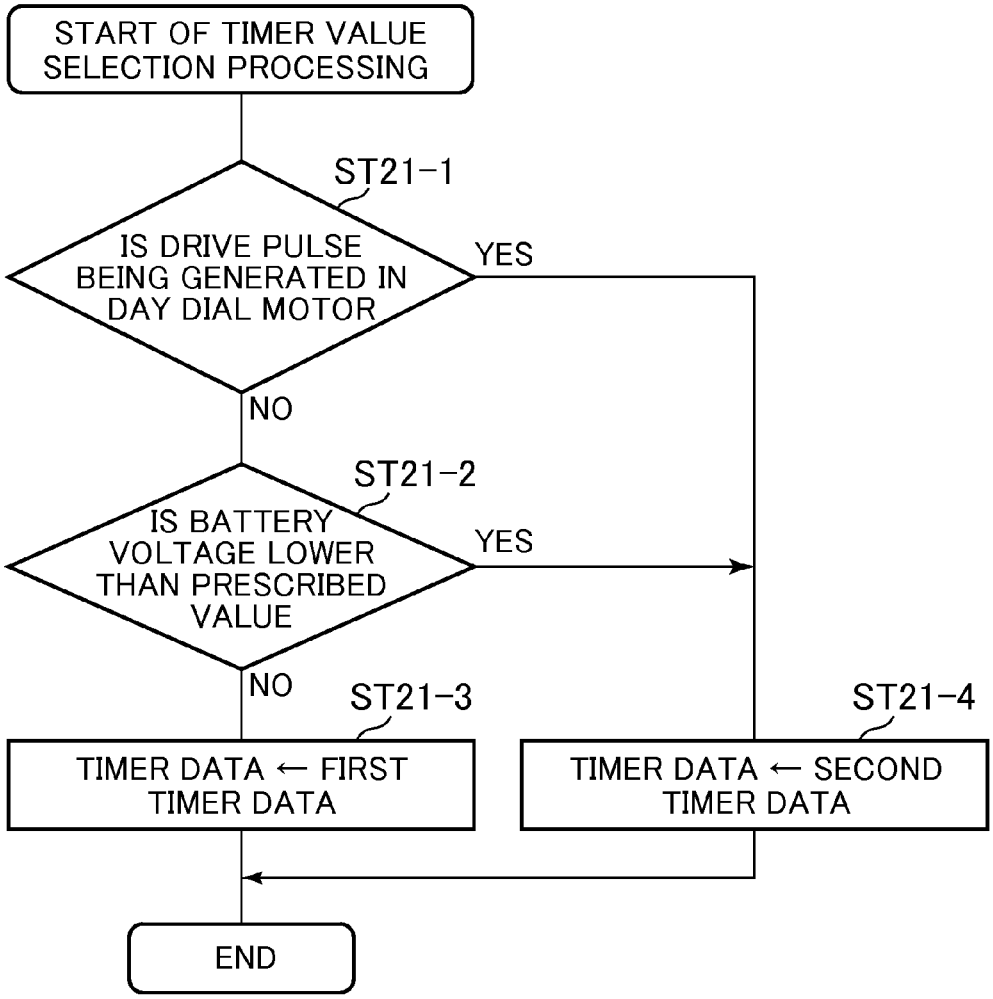
FIG. 21 is a flow chart illustrating timer value selection processing.

Referring to FIG. 21, a description is given of selection processing for the first timer data 107-7 and the second timer data 107-8 in the storage unit 107-11.

FIG. 21 is a flow chart illustrating the selection processing for the above-mentioned timer values.

First, it is determined whether or not the date indicator driving motor 212 is driven for driving the day dial (ST21-1). When the date indicator driving motor 212 is driven (ST21-1: YES), the second timer data is selected as the timer value (ST21-4).

When the date indicator driving motor 212 is not driven (ST21-1: NO), it is determined by the power supply voltage measurement circuit 211 whether or not a battery voltage is lower than a prescribed value (ST21-2). When the battery voltage is lower than the prescribed value (ST21-2: YES), the second timer data is selected as the timer value (ST21-4), and otherwise (ST21-2: NO), the first timer data is selected as the timer value (ST21-3).

The date indicator driving processing is performed when the correction operation of the hour hand position is performed by the user to move the hour hand beyond the 12 o'clock (midnight) position and stop the hour hand. However, it takes time to complete the date indicator driving operation.

In the date indicator driving processing, for example, even if the hour hand is moved again beyond the 12 o'clock (midnight) position by the correction operation during the date indicator driving processing and if the movement of the crown operation is stopped by an operator's operation so that the hour hand stops for a short time, by selecting the second timer data 107-8, the stop determination time becomes longer, and hence the hour hand position information circuit 107 is less likely to determine that the hour hand has stopped. Thus, the CPU 3 can be reduced in frequency of receiving the start HR signal S9 and the stop HR signal S10 that request the reading processing from the hour hand position information circuit 107 during the date indicator driving processing, and hence the load on the CPU 3 can be reduced.

Further, in the case where the user repeats a reciprocating operation of the hour hand to move the hour hand beyond the 12 o'clock (midnight) position continuously, a determination that the hour hand has stopped for a short time occurs at the moment when the movement direction of the hour hand is changed, and the CPU 3 receives the stop HR signal S10. Thus, the date indicator driving processing occurs correspondingly to the reciprocation of the hour hand, and the time-consuming operations of the date indicator driving and the date indicator reverse driving are repeated unnecessarily. By selecting the second timer data 107-8, the CPU 3 does not respond to the short stop of the hour hand during the date indicator driving processing, and hence the date indicator driving processing can be minimized to prevent wasted power consumption.

In addition, also in the case where the power supply voltage is measured by the power supply voltage measurement circuit 211 to be lower than a prescribed voltage or less, the CPU 3 selects the second timer data. In the date indicator driving processing, the pulse is continuously driven for the date indicator driving motor, and hence the power is consumed. If the date indicator driving is continuously repeated under the state in which the power supply voltage is low, there is a fear that the voltage is further reduced to be lower than a minimum operation voltage of the system. Thus, in the period during which the power supply voltage is low, the second timer data 107-8 is selected to set a longer stop determination time so that the CPU 3 is prevented from responding to an instantaneous operation stop during the user's operation of the hour hand, to thereby minimize the continuous date indicator driving. In this manner, the number of processing of the CPU 3 can also be reduced to suppress the reduction in power. Further, the CPU 3 may select the second timer data 107-8 in the period during which a heavy load function involving the reduction in power supply such as the hand position detection circuit 203 operates. Alternatively, the second timer data may be selected from the beginning by the setting by the user irrespective of the condition. In this manner, a timer time suitable for the user's feeling of operation can be set. Note that, in this case, when three or more timer values are prepared for selection, fine adjustment for the user's feeling of operation can be made.

Modified Example of the Stop Determination Circuit

Figure 19:
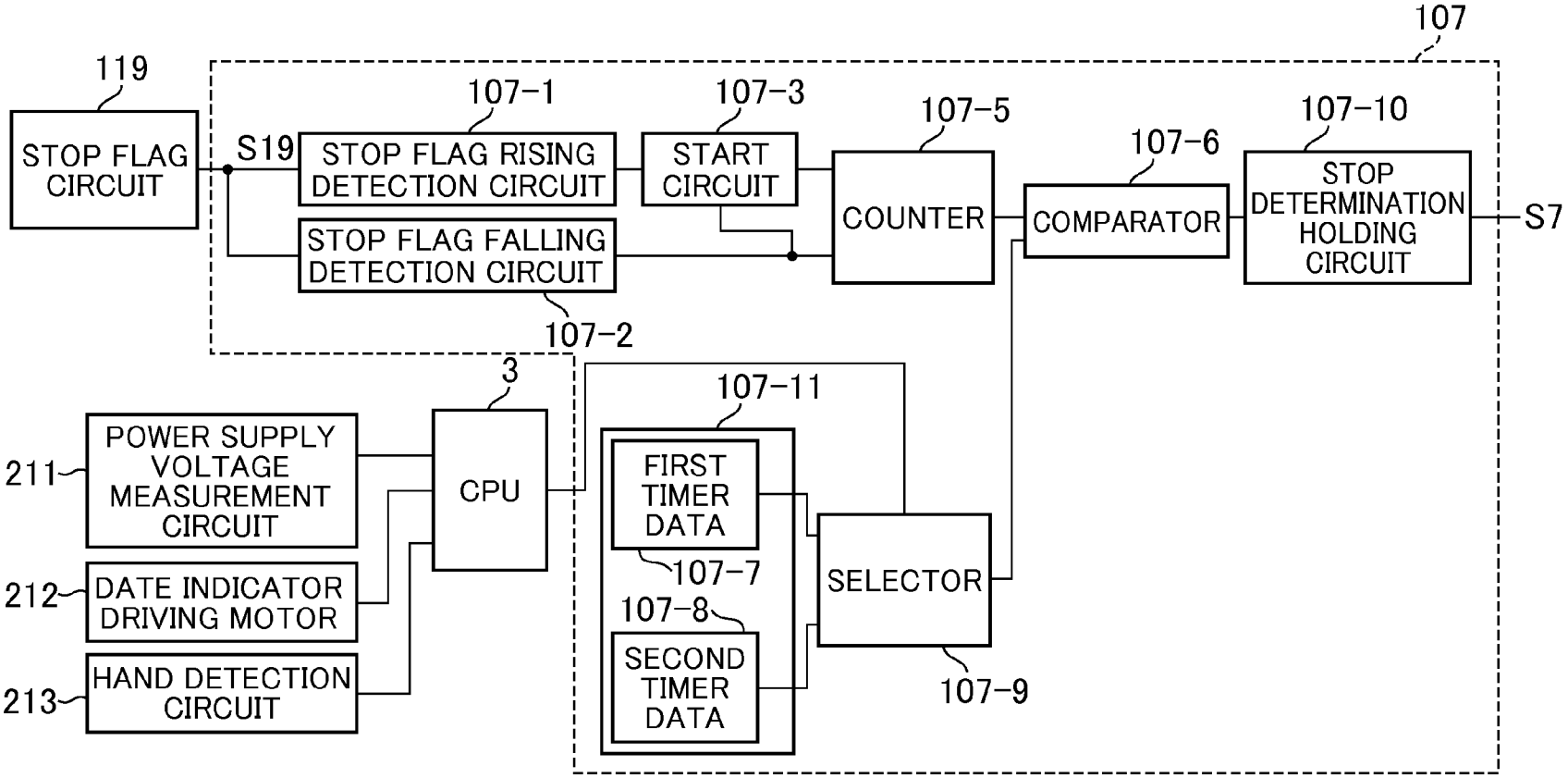
FIG. 19 is a block diagram illustrating a modified example of the stop determination circuit.

FIG. 19 is a modified example of the circuit of FIG. 18. FIG. 19 is different from FIG. 18 in the configuration from the input S19 to the counter circuit. Specifically, a stop flag rising detection circuit 107-1, a stop flag falling detection circuit 107-2, and a start circuit 107-3 are added.

The output S19 of the stop flag circuit is input to the stop flag rising detection circuit 107-1 and the stop flag falling detection circuit 107-2, and an output of the stop flag rising detection circuit is input to the start circuit 107-3. Further, an output of the stop flag falling detection circuit is input to the start circuit and a reset of the counter 107-5. An output of the start circuit is input to an enable of the counter, and an output of the counter is input to the comparator 107-6. As described above, by detecting the leading edge of the output S19 of the stop flag circuit 119 and by turning on the start circuit 107-3 to operate the counter 107-5, the following advantage occurs. That is, the stop flag circuit 119 is formed of a combinational circuit such as an exclusive OR, and hence a hazard is liable to occur upon the switching of the input signal. If the hazard propagates to an enable signal for controlling the operation of the counter 107-5, the reliability of the counter value is lowered. On the other hand, by producing a start signal synchronized with a clock in accordance with an ON duration of the stop flag signal S19 as illustrated in FIG. 19 and by inputting the start signal to the enable of the counter, an erroneous operation of the counter can be prevented without being affected by the hazard of the stop flag signal.

Fourth Embodiment

A fourth embodiment of the present invention is described with reference to FIG. 22. In the fourth embodiment, a stop determination period of the stop determination circuit 107 in the hand position information circuit 2 is set to be shorter than a time required for the hour hand to pass the region "0". In this manner, each time the hour hand passes the region "0", the stop determination occurs during the passing through the region "0".

Figure 22:
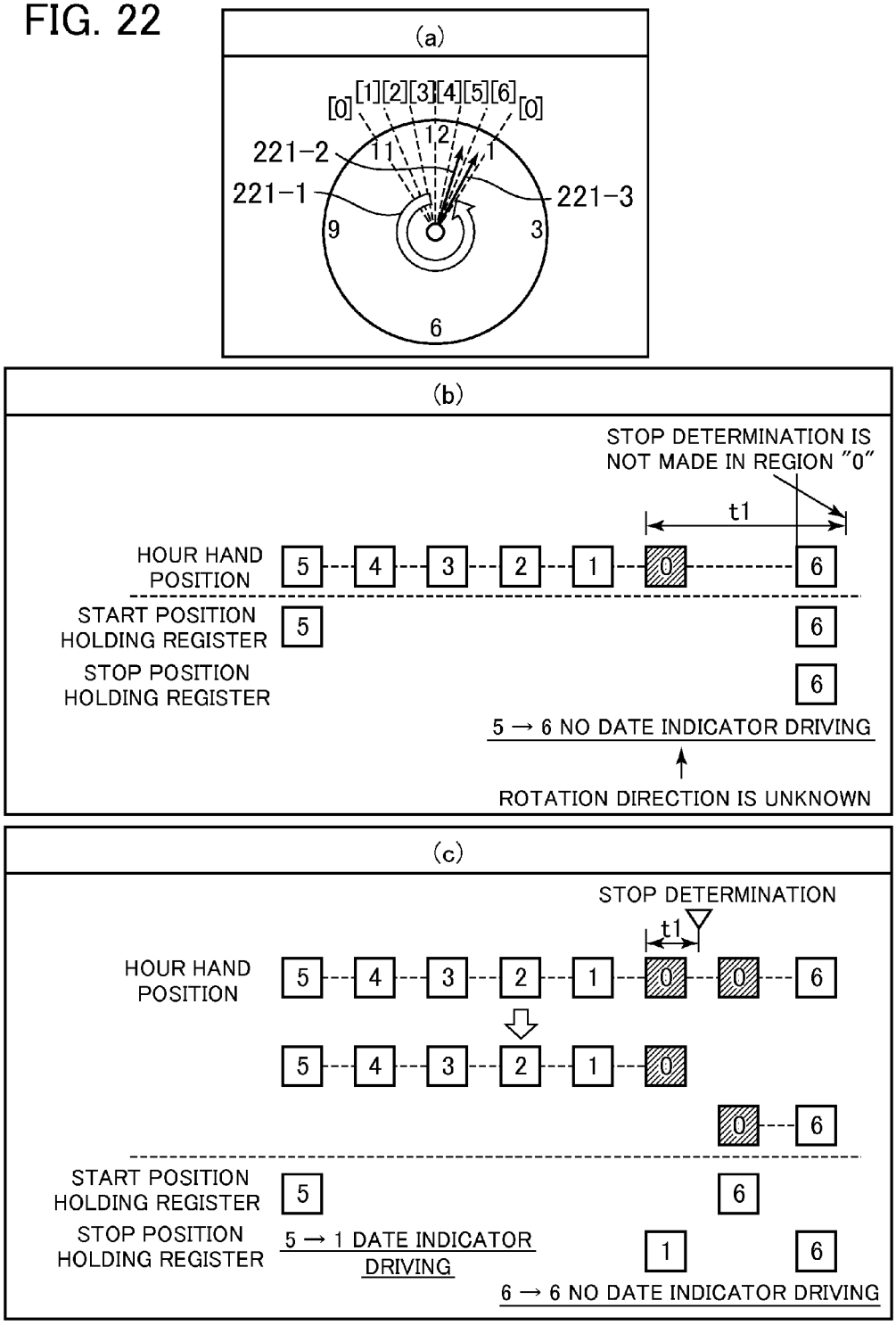
FIG. 22 is a diagram illustrating details of processing according to a fourth embodiment of the present invention.

Part (a) of FIG. 22 is an example of the hour hand movement. In order to show the effect of the above-mentioned stop determination period setting method, parts (b) and (c) of FIG. 22 illustrate how the position region data of the start position holding register 111 and the stop position holding register 112 differs depending on whether or not the above-mentioned stop determination period setting method is performed. In part (a) of FIG. 22, reference numeral 221-1 represents the rotation direction of the hour hand; 221-2, the movement start position of the hour hand; and 221-3, the stop position of the hour hand. The hour hand position in the diagrams of parts (b) and (c) shows the region data output from the decode circuit 1 in the course of the movement of the hour hand in the form of a time-series transition from the left to the right. Numerical values of the start position holding register and the stop position holding register shown in FIG. 22 represent the pieces of region data of the hour hand position that are acquired by the start position holding register 111 and the stop position holding register 112 along with the above-mentioned operation described in the second embodiment. t1 represents the stop determination time of the stop determination circuit 107. Part (b) shows the region data of the start position holding register and the stop position holding register acquired in the case where the stop determination period setting method is not performed, that is, in the case where the stop determination time t1 is longer than the time required for the hour hand to pass the region "0". On the other hand, part (c) shows the region data of the start position holding register and the stop position holding register acquired in the case where the stop determination period setting method is performed, that is, in the case where the stop determination time t1 is shorter than the time required for the hour hand to pass the region "0". In the example of part (a) of FIG. 22, the hour hand moves in the order of the regions "5", "4", "3", "2", "1", "0", and "6", and the region "5" is held in the start position holding register 111.

In part (b) of FIG. 22, the above-mentioned stop determination time setting method is not performed, and hence the stop determination period t1 is larger than the region "0" passage time, and the stop determination is not made within the time during which the hour hand passes the region "0". The hour hand thereafter passes the region "0" and stops in "6". Thus, the start position holding register holds "6" indicating the region next to the region "0", and the stop position holding register 112 holds the region "6" where the hour hand has stopped, which are fetched into the CPU 3. Accordingly, the CPU 3 erroneously recognizes that the hour hand has moved from "5" to "6", and hence does not perform the date indicator driving (date indicator reverse driving) processing. In other words, despite the fact that the hour hand 203 has moved beyond the 12 o'clock (midnight) position, it is erroneously determined not to perform the date indicator driving (date indicator reverse driving) processing.

On the other hand, in part (c) of FIG. 22, the above-mentioned stop determination period setting method is performed, and hence the stop determination time t1 is smaller than the region "0" passage time of the hour hand, and the stop determination is surely made while the hour hand is passing the region "0".

Operation in the Fourth Embodiment

Next, a description is given of the operation. When the hour hand starts to move, the region "5" is held in the start position holding register 111. When the hour hand continues to move and enters the region "0", the position region data remains unchanged for a while, and hence the stop flag circuit 119 continues to generate S19. In the stop determination circuit 107, the stop determination time t1 is smaller than the region "0" passage time, and hence a stop determination occurs during the passage through the region "0". Then, by the region "0" processing described in the second embodiment, "1" indicating one region before the region "0" is held in the stop position holding register 112 and fetched into the CPU 3. The CPU 3 performs the date indicator driving (date indicator reverse driving) processing because the hour hand has moved from the region "5" to the region "1".

After that, the hour hand moves from the region "0" to the region "6", and hence, based on the region "0" processing described in the second embodiment, "6" indicating the region next to the region "0" is held in the start position holding register 111. When the hour hand further continues to move and stops in the region "5", the region "5" is held in the stop position holding register 112 and fetched into the CPU 3. Accordingly, the CPU 3 does not perform the date indicator driving (date indicator reverse driving) processing because the hour hand has moved from "6" to "5". Consequently, even when the hour hand has passed the region "0" and moved beyond the 12 o'clock (midnight) position, the date indicator driving processing can be reliably performed.

[Method of Setting the Stop Determination Time t1]

Figure 23:
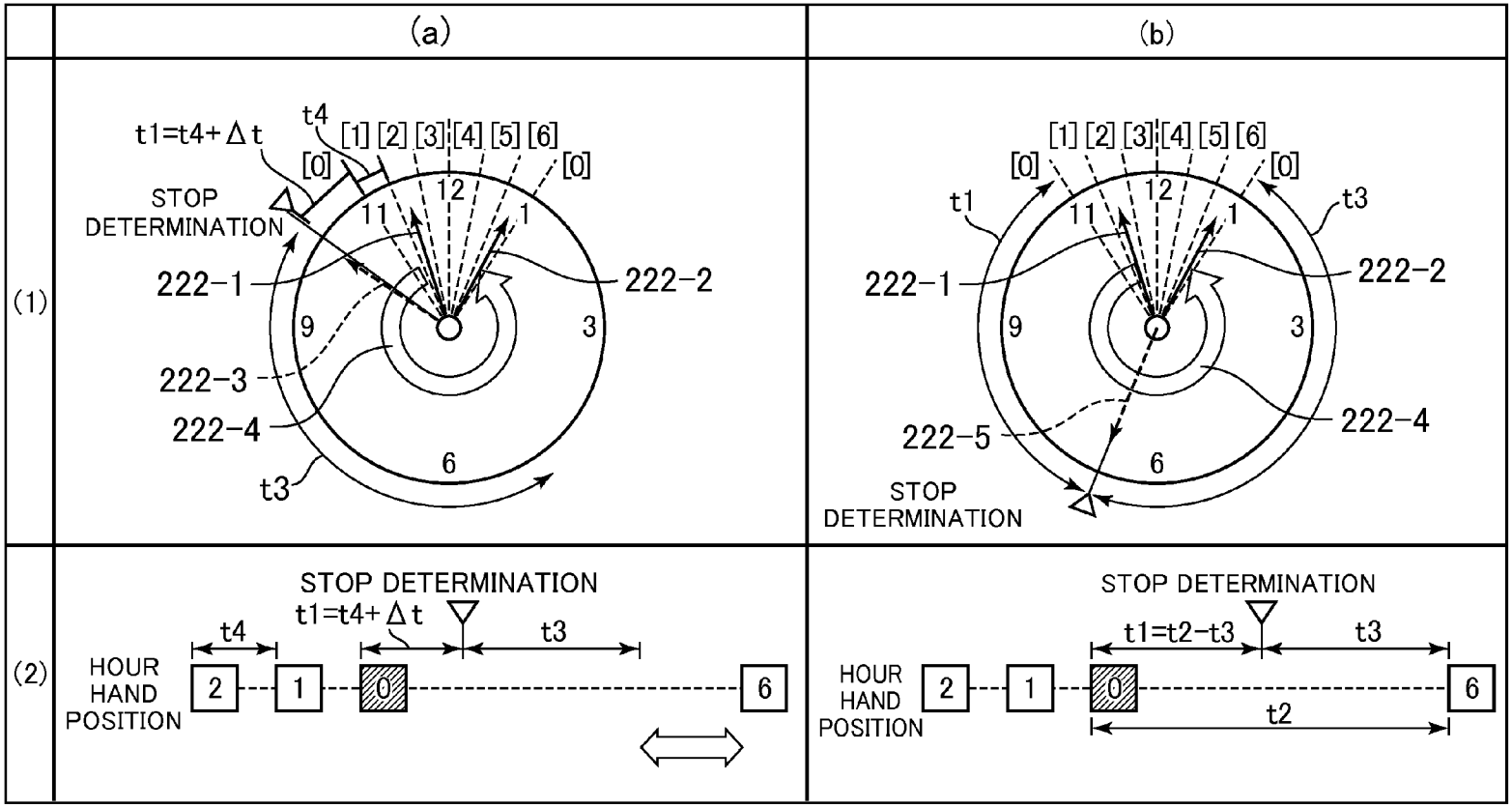
FIG. 23 is a diagram illustrating a method of setting a stop determination time according to the fourth embodiment of the present invention.

FIG. 23 illustrates a method of setting the stop determination time t1 according to the fourth embodiment. FIG. 23 illustrates how to set a minimum value and a maximum value of the stop determination time t1 in order to define the stop determination time t1 so that a stop determination is reliably made during the passage of the hour hand through the region "0". Part (a) shows the minimum value of the stop determination period t1, and part (b) shows the maximum value of the stop determination period t1. Part (1) shows a movement route of the hour hand and the stop determination time, and part (2) shows the region data output from the decode circuit 1 along with the movement of the hour hand in chronological order from left to right.

The output of the decode circuit 1 is asynchronous with a change timing of the port clock SP of the hand position information circuit 2, and hence the holding timing of the hour hand position information circuit is not constant with respect to the change timing of the decoded signal. An error time Δt is a time taking this time fluctuation into account, and may be, for example, a longer one of a time corresponding to two periods of the hour hand motor driving pulse and a time corresponding to two periods of the port clock. t2 is a time required for the hour hand to pass the region "0", and t3 is a processing estimated time of the CPU 3. t4 is the longest one of the times required for the hour hand to pass the respective regions "1" to "6". In the case where the respective regions "1" to "6" have equal intervals, any passage time for the regions may be set. In FIG. 23, reference numeral 222-1 represents the movement start position of the hour hand; 222-2, the stop position of the hour hand; 222-3, a stop determination position when t1 is the minimum value; 222-4, the rotation direction of the hour hand; and 222-5, an hour hand position when t1 is the maximum value.

For parts (a) and (b) of FIG. 23 both, a description is given with the assumption that the hour hand has moved in the order of the regions "2", "1", "0", and "6". Part (a) of FIG. 23 illustrates the minimum value of the stop determination time t1, in which the stop determination time t1 is set to a period acquired by adding t4 to an error time Δt. In this case, the stop determination circuit 107 quickly determines the stop of the hour hand when the passage time of one region and the error time have elapsed since the hour hand entered the region "0", and then the hand position information circuit 2 transmits the data of the stop position holding register 112 to the CPU 3. The CPU 3 can finish the date indicator driving processing well in advance by the time the hour hand arrives at the region "6", and hence, even when the hour hand enters the region "6" and the movement detection circuit 105 sets the movement start signal S4 to "1" to prompt the CPU 3 to fetch the data of the start position holding register 111, the CPU 3 can immediately respond to the prompt. Consequently, the acquisition of the stop position holding register 112, which is the next process, and the date indicator driving processing can be performed without any delay.

Part (b) of FIG. 23 shows the maximum value of the stop determination time t1, and the stop determination time t1 is set to a time acquired by subtracting a CPU processing estimated time t3 from the time t2 during which the hour hand passes the overall width of the region "0". In this manner, the date indicator driving processing of the CPU 3 can reliably be finished by the time the hour hand arrives at the detection region "6", and further, the stop determination time can be lengthened as much as possible. Consequently, the CPU 3 can be prevented from easily responding to the short stop of the hour hand during the user's operation of the hour hand, and hence the date indicator driving processing can be minimized to prevent wasted power consumption.

The invention claimed is:

1. An electronic watch, comprising:

an indicator;

a decode circuit configured to segment a whole movable region of the indicator into at least a region A having predetermined width before a specific position and a region B having predetermined width after the specific position, and output region data, said region data indicates in which position the indicator is in, within at least the region A and the region B;

a position information circuit configured to acquire movement start region data corresponding to a movement start position of the indicator and stop region data corresponding to a stop position after start of movement, and configured to output, when the movement start region data or the stop region data are acquired, an acquisition signal indicating that one or both of the movement start region data and stop region data are acquired; and a control unit configured to acquire the movement start region data and the stop region data from the position information circuit in response to the acquisition signal from the position information circuit, and configured to perform processing including a determination whether the indicator passes the specific position and a determination of a movement direction of the indicator.

2. The electronic watch according to claim 1, wherein:

the position information circuit comprises a start circuit configured to acquire the movement start region data, and a stop circuit configured to acquire the stop region data; and wherein the stop circuit stops itself during an operation of the start circuit, and starts to operate after the movement start region data is acquired by the start circuit.

3. The electronic watch according to claim 2, wherein the acquisition signal is output from the stop circuit when the stop region data is acquired by the stop circuit.

4. The electronic watch according to claim 2 wherein:

the start circuit compares the region data and previous stop region data at a predetermined timing, determines that the movement starts when it is determined that the region data and the previous stop region data do not match with each other, and stores a value of the region data at that time as the movement start region data; and after the start circuit stores the region data as the movement start region data, the stop circuit fetches the region data at a predetermined interval, determines that the movement stops when the fetched region data remains the same for a predetermined period of time or longer, and stores a value of the region data at that time as the stop region data.

5. The electronic watch according to claim 4, wherein the whole movable region of the indicator is segmented within a limited region around the specific position in order to determine that the indicator passes the specific position, and is divided into a plurality of effective regions for outputting different pieces of the region data and a single invalid region other than the plurality of effective regions, the electronic watch further comprising:

an invalid region detection circuit configured to:

determine whether or not the movement start region data and the stop region data are invalid region data corresponding to the invalid region; and replace, when the movement start region data is the invalid region data, the movement start region data with region data of one of the plurality of effective regions that appears next to the invalid region in a movement direction of the indicator, and replace, when the stop region data is the invalid region data, the stop region data with region data of one of the plurality of effective regions that appears before the invalid region in the movement direction of the indicator, wherein the predetermined period of time for determining the stop is set to be shorter than a time required for the indicator to pass the invalid region.

6. The electronic watch according to claim 4 wherein the stop circuit comprises:

a timer for measuring the predetermined period of time for determining when the movement stops, and wherein the timer is configured to set a plurality of count-up values.

7. The electronic watch according to claim 2, wherein the whole movable region of the indicator is segmented within a limited region around the specific position in order to determine that the indicator passes the specific position, and is divided into a plurality of effective regions for outputting different pieces of the region data and a single invalid region other than the plurality of effective regions, the electronic watch further comprising:

an invalid region detection circuit configured to:

determine whether or not the movement start region data and the stop region data are invalid region data corresponding to the invalid region; and replace, when the movement start region data is the invalid region data, the movement start region data with region data of one of the plurality of effective regions that appears next to the invalid region in a movement direction of the indicator, and replace, when the stop region data is the invalid region data, the stop region data with region data of one of the plurality of effective regions that appears before the invalid region in the movement direction of the indicator, wherein:

the start circuit compares the region data and previous stop region data at a predetermined timing, determines that the movement starts when it is determined that the region data and the previous stop region data do not match with each other, and stores a value of the region data at that time as the movement start region data; and after the start circuit stores the region data as the movement start region data, the stop circuit fetches the region data at a predetermined interval, determines that the movement stops when the fetched region data remains the same for a predetermined period of time or longer, and stores a value of the region data at that time as the stop region data.

8. The electronic watch according to claim 7, wherein the predetermined period of time for determining the stop is set to be shorter than a time required for the indicator to pass the invalid region.

9. The electronic watch according to claim 1, wherein the whole movable region of the indicator is segmented within a limited region around the specific position in order to determine that the indicator passes the specific position, and is divided into a plurality of effective regions for outputting different pieces of the region data and a single invalid region other than the plurality of effective regions.

10. The electronic watch according to claim 9, further comprising:

an invalid region detection circuit configured to:

determine whether or not the movement start region data and the stop region data are invalid region data corresponding to the invalid region; and replace, when the movement start region data is the invalid region data, the movement start region data with region data of one of the plurality of effective regions that appears next to the invalid region in a movement direction of the indicator, and replace, when the stop region data is the invalid region data, the stop region data with region data of one of the plurality of effective regions that appears before the invalid region in the movement direction of the indicator.

11. The electronic watch according to claim 1, wherein said determination of the movement direction of the indicator is based on the start region data position data, the stop region position data and a third region position data.

* * * * *